US007413592B2

(12) United States Patent
Bleifuss et al.

(10) Patent No.: US 7,413,592 B2
(45) Date of Patent: Aug. 19, 2008

(54) LINEAR HEARTH FURNACE SYSTEM AND METHODS REGARDING SAME

(75) Inventors: Rodney L. Bleifuss, Grand Rapids, MN (US); David J. Englund, Bovey, MN (US); Richard F. Kiesel, Hibbing, MN (US)

(73) Assignee: Nu-Iron Technology, LLC, Charlotte, NC (US)

( * ) Notice: Subject to any disclaimer, the term of this patent is extended or adjusted under 35 U.S.C. 154(b) by 259 days.

(21) Appl. No.: 11/095,005

(22) Filed: Mar. 31, 2005

(65) Prior Publication Data

US 2005/0229748 A1 Oct. 20, 2005

Related U.S. Application Data

(60) Provisional application No. 60/558,197, filed on Mar. 31, 2004.

(51) Int. Cl.
*C21B 11/00* (2006.01)

(52) U.S. Cl. ..... 75/485

(58) Field of Classification Search ..... 75/484, 75/483, 485, 475, 480; 266/172, 178
See application file for complete search history.

(56) References Cited

U.S. PATENT DOCUMENTS

| | | | | |
|---|---|---|---|---|
| 1,738,039 A | | 12/1929 | Cope et al. | |
| 1,885,381 A | | 11/1932 | Simpson | |
| 1,936,239 A | | 11/1933 | Kuhlman | |
| 2,367,262 A | * | 1/1945 | Brassert | 75/436 |
| 3,212,876 A | * | 10/1965 | Hulthen et al. | 148/513 |
| 3,471,134 A | | 10/1969 | Cone | |
| 3,645,321 A | * | 2/1972 | Robinson | 164/509 |
| 3,658,171 A | | 4/1972 | Fukada | |
| 3,708,157 A | * | 1/1973 | Aubry et al. | 432/66 |
| 3,820,946 A | | 6/1974 | Myoshi et al. | |

(Continued)

FOREIGN PATENT DOCUMENTS

| | | |
|---|---|---|
| CN | 1134983 | 11/1996 |

(Continued)

OTHER PUBLICATIONS

ASM Handbook, vol. 7, Powder Metallurgy, ASM International, 1984, pp. 351-359.*

(Continued)

*Primary Examiner*—Roy King
*Assistant Examiner*—Tima M McGuthry-Banks
(74) *Attorney, Agent, or Firm*—Hahn Loeser & Parks LLP

(57) ABSTRACT

Systems and methods for use in processing raw material (e.g., iron bearing material) include a linear furnace apparatus extending along a longitudinal axis between a charging end and a discharging end (e.g., the linear furnace apparatus includes at least a furnace zone positioned along the longitudinal axis). Raw material is provided into one or more separate or separable containers (e.g., trays) at the charging end of the linear furnace apparatus. The separate or separable containers are moved through at least the furnace zone and to the discharging end where the processed material is discharged resulting in one or more empty containers. One or more of the empty containers are returned to the charging end of the linear furnace apparatus to receive further raw material.

18 Claims, 14 Drawing Sheets

U.S. PATENT DOCUMENTS

| | | | | |
|---|---|---|---|---|
| 4,082,543 | A | 4/1978 | Beggs et al. | |
| 4,421,481 | A | 12/1983 | Holz et al. | |
| 4,579,319 | A | 4/1986 | Sasaki | |
| 4,674,975 | A | 6/1987 | Corato et al. | |
| 4,778,383 | A | 10/1988 | Strobel et al. | |
| 4,778,384 | A | 10/1988 | Lingl, Jr. | |
| 4,834,649 | A | 5/1989 | Levit et al. | |
| 4,929,177 | A | 5/1990 | Paul | |
| 5,314,169 | A | 5/1994 | Kamlani et al. | |
| 5,648,042 | A * | 7/1997 | Miller, Jr. | 266/44 |
| 5,900,208 | A * | 5/1999 | Wittmer et al. | 266/44 |
| 5,961,055 | A | 10/1999 | Lehtinen | |
| 5,972,066 | A | 10/1999 | Lehtinen | |
| 6,036,744 | A | 3/2000 | Negami et al. | |
| 6,126,718 | A | 10/2000 | Sawa et al. | |
| 6,210,462 | B1 | 4/2001 | Kikuchi et al. | |
| 6,251,156 | B1 | 6/2001 | Hoffman et al. | |
| 6,251,161 | B1 | 6/2001 | Tateishi et al. | |
| 6,257,879 | B1 | 7/2001 | Lu et al. | |
| 6,270,552 | B1 | 8/2001 | Takeda et al. | |
| 6,413,471 | B1 | 7/2002 | Kamikawa et al. | |
| 6,447,713 | B1 | 9/2002 | Monteyne | |
| 6,506,231 | B2 | 1/2003 | Negami et al. | |
| 2001/0027701 | A1 | 10/2001 | Ito et al. | |
| 2001/0037703 | A1 | 11/2001 | Fuji et al. | |
| 2001/0054329 | A1 | 12/2001 | Hoffman et al. | |

FOREIGN PATENT DOCUMENTS

| | | | |
|---|---|---|---|
| GB | 1 501 947 | * | 11/1975 |
| GB | 1501947 | | 11/1975 |
| JP | 05-347349 | * | 12/1993 |
| JP | 2002-146511 | * | 5/2002 |
| WO | WO 99/51783 A1 | | 10/1999 |

OTHER PUBLICATIONS

Machine translation of Japanese patent document 05-347349.*
Machine translation of Japanese patent document 2002-146511.*
Webster's Seventh New Collegiate Dictionary, Merriam Co., 1965, p. 720.*
Asano et al., "Development of $Al_2o_3$-C Refractories for Iron-ore Smelting Reduction Furnace," *Taikabutsu*, 1990;42(8):435-436. (English language abstract only).
Bold et al., "Direct reduction down under: the New Zealand story," *Iron and Steel International*, 1977; 50(3):145 and 147-152.
Bryk et al., "Continuous Reduction of Iron Ore with Coal in an Electrically Heated Furnace," *Canadian Metallurgical Quarterly*, 1986;25(3):241-246.
Greene, "The Production of Steel Direct from Ore by the Hearth Furnace Method," *Mining World*, 1944:31-33.
Hanewald, "Lessons Learned from INMETCO's 20 Years of RHF Experience," presentation, Iron Ore for Alternative Iron Units 99, Charlotte, NC, Oct. 25-27, 1999:16 pgs.
Hoffman et al., "A Look at Development of the FASTMELT™ Technology at the Midrex Technical Center," Ironmaking Conference Proceedings, 1999, 367-373.
Ichikawa et al., "Effective Use of Steelmaking Dust and Sludge by Use of Rotary Hearth Furnace," Nippon Steel Technical Report No. 86, Jul. 2002:35-38.
Inaba, "Overview of New Direct Reduced Iron Technology," *Journal of the Iron and Steel Institute of Japan*, 2001;87(5):17-23. (English language abstract only).
Kamijo et al., "Production of direct reduced iron by a sheet material inserting metallization method," *ISIJ International*, 2001;41, Supplement:S13-S16.
Kobayashi et al., "A New Process to Produce Iron Directly from Fine Ore and Coal," I&SM, Sep. 2001:19-22.
"KSC Develops New Ironmaking Process," *I&SM*, International Report Japan, Oct. 2001, 1 pg.
Lepinski et al., "Producing Direct Reduced Iron Utilizing Rotary Hearth Furnace," *Industrial Heating*, 1994:28-31.
Lu, "RHF/SAF and Their Potential Successors," presentation, Iron Ore for Alternative Iron Units 99, Charlotte, NC, Oct. 25-27, 1999:23 pgs.
Matsumura et al., "The Reduction and Melting Behavior of Carbon Composite Iron Ore Pellet on High Temperature," *Journal of the Iron and Steel Institute of Japan*, 1998;84(6):405-410 (English language abstract only).
Misra et al., "Development of Firing Schedule to Prepare Composite Pre-reduced (CPR) Pellets," *ISIJ International*, 1994;34(6):468-475.
Miyagawa et al., "Development of the FASTMET® as a New Direct Reduction Process," ICSTI/Ironmaking Conference Proceedings, 1998:877-881.
Negami, "Premium Iron Shot Making by ITmk3," Beyond the Blast Furnace, Atlanta Airport Marriott, Jun. 5-7, 2000:pp. 1, 3, 5, 7, 9.
Pandey et al., "Reducing agents and double-layered iron ore pellets," *Int. J. Miner Process*., 2000;59:295-304.
Rinker, "Using the DRyIron™ process to produce value-added iron units," *Minerals & Metallurgical Processing*, 2001;18(1):45-48.
Ross et al., "The Agglomeration of Iron-Ore Materials and Their Behaviour During Reduction," Agglomeration 77, Proceedings of the 2nd International Symposium on Agglomeration 77, Atlanta, GA, Mar. 6-10, 1977;1:336-355.
Sawa et al., "New coal-based process, Hi-QIP, to produce high quality DRI for the EAF," *ISIJ International*, 2001;41:11 pgs.
Sharma, "Composite prereduced pellet—new feed for iron and steel industry," *Ironmaking and Steelmaking*, 1992;19(5):372-376.
Development of A1203-C Refractories for Iron-Ore Smelting Reduction Furnace, Asano et al., 1990.
International Search Report for PCT/US05/34597.
Written Opinion for PCT/US05/34597.

* cited by examiner 22
10
54
63
34
62
64
31
30
38
38
28
18
27
40
Controller
52
20

LINEAR HEARTH FURNACE SYSTEM AND METHODS REGARDING SAME

CROSS-REFERENCE TO RELATED APPLICATIONS

This application claims the benefit of U.S. Provisional Application Ser. No. 60/558,197 filed 31 Mar. 2004, which is incorporated herein by reference in its entirety.

STATEMENT OF GOVERNMENT RIGHTS

The present invention was made with support by the Economic Development Administration, Grant No. 06-69-04501. The government may have certain rights in the invention.

BACKGROUND OF THE INVENTION

The present invention relates to systems, apparatus, and/or methods for use in the processing of metal bearing material (e.g., the reduction of iron bearing materials such as iron oxide using a direct reduction process).

Hearth furnaces have been manufactured for decades and present a proven technology for various purposes, including reduction of metal bearing materials. Such furnaces have been widely used in the mineral industry for drying, preheating, roasting, calcining, steel plant waste treatment, iron ore reduction, and production of metallic iron nuggets. A process to produce direct reduced iron (DRI) may involve the following generalized processing steps: feed preparation, drying, furnace charging, preheating, reduction, cooling, product discharge, and product passivation. A process to produce metallic iron nuggets may involve all of the steps for producing direct reduced iron plus a high temperature step in which the metallic iron formed is fused to form metallic iron nuggets, and the associated slag melts and segregates from the iron. In addition, a physical separation step is generally required to separate the metallic iron nuggets from the slag and furnace hearth layer after the products have cooled and solidified.

Various issues related to the design of such furnaces (e.g., those used to produce DRI or metallic iron nuggets) include, but are clearly not limited to, material handling, engineering/construction, maintenance, flue gas treatment to remove particulates and recover sensible heat, and in some cases provide it as make-up gas, hearth integrity, and overall system reliability.

One type of hearth furnace, referred to as a rotary hearth furnace (RHF) has been adapted for the production of DRI and metallic iron nuggets. Several rotary hearth furnaces have been built for DRI production. For example, one such RHF is used in the FASTMET process developed by Midrex Corporation and is described in the article "Development of the FASTMET as a New Direct Reduction Process," by Miyagawa et al., 1998 ICSTI/IRONMAKING Conference Proceedings.

The RHF has also been used to produce metallic iron nuggets. For example, such processes include the ITmk3 process described in U.S. Pat. No. 6,036,744, to Negami et al., entitled "Method and apparatus for making metallic iron," and also the QIP process, described in the article "New coal-based process, Hi-QIP, to produce high quality DRI for the EAF," by Sawa et al., ISIJ International, Vol. 41 (2001).

Processing in a typical RHF operation may include forming balls, briquets, or similar agglomerates composed of a mixture of iron ore, reductants (e.g., coal anthracite, coke, etc.), various slagging constituents (e.g., lime hydrate, fluorspar, soda-ash, etc.), water, and binders (e.g., bentonite or lime hydrate). The agglomerates may be dried in a separate drying oven and charged to the hearth of the furnace in a charging zone thereof, or perhaps, wet agglomerates may be charged directly to the hearth of the furnace in the charging zone.

The hearth is rotated to carry the agglomerates from the charging zone into a preheat zone of the RHF where the temperature is increased so as to drive off most of the volatile matter from the coal and other additives. Further rotation of the hearth carries the agglomerates into a higher temperature reduction zone where the carbonaceous constituents react with the iron oxide in the agglomerates to reduce the iron therein to metallic iron. Still further rotation of the hearth carries the largely reduced agglomerates into a high temperature fusion zone of the RHF where the iron melts and fuses to form iron nuggets and the slag fuses and separates from the metallic iron. Yet further rotation of the hearth carries the charge into the cooling zone of the furnace where both the iron and slag solidify. The hearth materials are then discharged for supplementary cooling and passivation.

One will recognize that in the production of DRI, the high temperature fusion and melting zone would not be included in the RHF. Rather, the solid DRI produced in the reduction zone would be cooled, discharged, and passivated.

The RHF has various inherent limitations. For example, feed distribution to the RHF is difficult because of the difference between the annular speed of the near and far sides of the hearth. Further, the feed must be pre-dried, i.e., if RHF area has to be dedicated to drying, the remainder of the RHF area available for production of DRI is reduced.

In addition, feedstock in the form of balls are considered a favored feedstock for iron ore concentrates to be used in a direct reduction process. Such balls are inherently fragile, especially when they contain nearly 40% volume of pulverized coal. Heat treatment of such balls in a RHF is generally non-uniform, i.e., balls on the short radius of the annular hearth receive intense direct radiation from wall burners for an appreciably greater length of time than those on the outer radius.

Further, discharge of such balls from the hearth requires that they maintain their physical integrity after reduction, which is often a problem. The balls are, for example, augered off the annular hearth and breakage could lead to jamming of the rotary hearth, damage to the hearth, or damage to an auger used for such discharge.

Various other limitations of the RHF relate to its physical construction. For example, the physical arrangement of a RHF necessarily leads to the cold feed side being next to the hot discharge side resulting in congestion and material handling complications. Further, the circular arrangement makes construction difficult (e.g., refractory, side walls, burners all have to be configured in a circular design) and the center of the RHF is congested and difficult to access for maintenance. Further, the design of the RHF, due to its circular arrangement, has size limitations placed thereon (e.g., about 60 meters diameter). For example, the hearth is generally massive and as such, problems in rotating such a large hearth increase with its size.

In addition to the RHF, other types of furnaces have also been described. For example, a paired straight hearth (PSH) furnace is described in U.S. Pat. No. 6,257,879B1 to Lu et al., issued 10 Jul. 2001, entitled "Paired straight hearth (PSH) furnaces for metal oxide reduction."

The PSH furnace generally includes a pair of straight moving hearth furnaces located side by side, each having a charging end and a discharging end. Each furnace has a train of detachable hearth sections to enable each hearth section to be removed at the discharging end of one furnace and attached at the charging end of the other furnace. In other words, charge is moved by two straight hearth furnaces from one end to the other, i.e., two parallel solid flows in opposite directions using two side-by-side parallel furnaces. The first flow includes a first feed end, a paired furnace, and a first discharge end. The second flow includes a second feed end, a paired furnace, and a second discharge end. After the charge loaded in a hearth section at the feed end of each flow passes through one of the paired furnaces, the charge is discharged, and the hearth section is moved to the feed or charging end of the other flow to receive new charge.

However, the PSH furnace also has associated problems. For example, the charging end of one of the paired furnaces is right next to the discharging end of the other paired furnace. As such, there is no separation between the hot and cold ends of the paired furnaces. Further, in the PSH furnace, it is necessary to duplicate both charge delivery and product removal systems at each end of the furnace. This requires a complicated distribution system, or, for example, doubling the charge metering system for multiple components and the blending and drying systems.

SUMMARY OF THE INVENTION

The systems, apparatus, and/or methods according to the present invention overcome one or more of the problems described herein relating to other previously used or described hearth furnace systems. One method according to the present invention for use in processing raw material (e.g., iron bearing material) includes providing a linear furnace apparatus extending along a longitudinal axis between a charging end and a discharging end, wherein the linear furnace apparatus includes at least a furnace zone positioned along the longitudinal axis. Raw material (e.g., raw material that includes an iron bearing material to be processed) is provided into one or more separate or separable containers (e.g., one or more separate or separable passive containers that lack self mobility, one or more separate or separable containers that include an underlying substructure supporting a refractory material, one or more containers that include an underlying substructure that has a floating planar bottom panel coupled to a frame portion such that the floating planar bottom panel is allowed to expand relative to the frame portion, one or more containers that includes a planar bottom panel having one or more slot openings defined therein so as to minimize warping in high temperatures, etc.) at the charging end of the linear furnace apparatus, wherein each of the separate or separable containers includes refractory material. The method further includes moving the one or more separate or separable containers through at least the furnace zone and to the discharging end of the linear furnace apparatus resulting in processed material in the one or more separate or separable containers. The processed material is discharged from the one or more separate or separable containers resulting in one or more empty containers. One or more empty containers are returned to the charging end of the linear furnace apparatus to receive further raw material.

In one embodiment, the linear furnace apparatus includes at least a preheat zone, a furnace zone (e.g., including furnace sub-zones such as a reduction zone, a fusion/melting zone, etc.), and a cooling zone (e.g., a water jacket) positioned along the longitudinal axis between the charging end and the discharging end.

In another embodiment, at least one of the preheat zone, the furnace zone, and the cooling zone is configured using multiple modular linear sections corresponding to the particular zone being configured to allow lengthening or shortening of the at least one zone along the longitudinal axis. The use of modular linear sections may also facilitate repair of the linear furnace apparatus. Further, the linear furnace apparatus may include one or more conduits that allow movement of one or more gases between one or more of the preheat zone, the furnace zone, the cooling zone, and sub-zones thereof.

In another embodiment of the method, moving the one or more separate or separable containers may be performed using a walking beam configuration (e.g., a walking beam configuration that is substantially mechanically sealed). For example, each of the one or more separate or separable containers may be supported by one or more transport beams (e.g., beams of insulating material) of the walking beam configuration as the one or more separate or separable containers are moved along the longitudinal axis of the linear furnace apparatus and through the furnace zone.

In another embodiment of the method, discharging the processed material from the one or more separate or separable containers includes tilting the one or more separate or separable containers to discharge the processed material using at least gravity.

In yet further embodiments of the method, returning the one or more empty containers to the charging end of the linear furnace apparatus may include immediately returning the one or more empty containers to the charging end of the linear furnace apparatus, returning the one or more empty containers to the charging end of the linear furnace apparatus in an upright state, and/or returning the one or more empty containers to the charging end of the linear furnace apparatus using a container return apparatus located directly below the linear furnace apparatus.

To facilitate maintenance of the systems, the method may further include removing one or more of the empty containers and replacing the one or more removed empty containers with one or more different empty containers.

A system for use in processing raw material according to the present invention is also described. The system may include one or more separate or separable containers configured to receive raw material (e.g., separate or separable containers that include refractory material). Further, the system includes a linear furnace apparatus extending along a longitudinal axis between a charging end and a discharging end. The linear furnace apparatus includes at least a furnace zone positioned along the longitudinal axis. The linear furnace apparatus is configured to move the one or more separate or separable containers (e.g., one or more separate or separable passive containers that lack self mobility) through at least the furnace zone and to the discharging end thereof for use in processing raw material received in the one or more separate or separable containers. Further, the linear furnace apparatus includes a discharge apparatus at the discharging end of the linear furnace apparatus operable to discharge processed raw material from the one or more separate or separable containers resulting in one or more empty containers (e.g., an apparatus operable to tilt the one or more separate or separable containers to discharge processed material therefrom using at least gravity). Yet further, the system includes a container return apparatus operable to return one or more empty containers to the charging end of the linear furnace apparatus to receive further raw material.

In one embodiment of the system, the linear furnace apparatus includes at least a preheat zone, a furnace zone, and a cooling zone positioned along the longitudinal axis between the charging end and the discharging end (e.g., one or more of the zones configured using multiple modular linear sections corresponding to the particular zone being configured to allow lengthening or shortening of the at least one zone along the longitudinal axis). Further, one or more of the zones may be divided into sub-zones by one or more baffle structures and one or more conduits may allow movement of one or more gases between one or more of the preheat zone, the furnace zone, the cooling zone, and sub-zones thereof.

In another embodiment of the system, the linear furnace apparatus includes a walking beam configuration (e.g., a walking beam configuration that is substantially mechanically sealed). The walking beam configuration may include one or more transport beams configured to support one or more separate or separable containers and operable to move the one or more separate or separable containers along the longitudinal axis of the linear furnace apparatus and through the furnace zone.

In yet further embodiments of the system, the container return apparatus may be operable to immediately return the one or more empty containers to the charging end of the linear furnace apparatus, the container return apparatus may be operable to return the one or more empty containers to the charging end of the linear furnace apparatus in an upright state, and/or the container return apparatus is located directly below the linear furnace apparatus.

The above summary of the present invention is not intended to describe each embodiment or every implementation of the present invention. Advantages, together with a more complete understanding of the invention, will become apparent and appreciated by referring to the following detailed description and claims taken in conjunction with the accompanying drawings.

BRIEF DESCRIPTION OF THE DRAWINGS

FIGS. 6A-6C show side cross-sectional views of one embodiment of a linear hearth furnace system shown generally in FIGS. 1-3 according to the present invention taken along line 6-6 of FIG. 7; wherein FIGS. 6B and 6C are enlarged views of the same named portions shown in FIG. 6A.

FIGS. 8A-8C show top views of a cross-section of the linear hearth furnace system shown in FIGS. 6A-6C and FIG. 7 taken at line 8-8 of FIG. 7; wherein FIGS. 8B and 8C are enlarged views of the same named portions shown in FIG. 8A.

FIG. 9A is a plan view of the carrier cart shown on a pair of tracks for guiding the cart; FIG. 9B is a front view of the carrier cart and such tracks with a container resting on transfer wheels thereof; FIG. 9C is a side view of the carrier cart shown on such tracks with a container resting on transfer wheels thereof; FIG. 9D is a top view of a discharge plate showing the positions of ramps used to discharge a container from the carrier cart; FIG. 9E is a side view of the carrier cart shown at the time of discharge of a container using the discharge plate of FIG. 9D (with only two of the transfer wheels shown for simplicity and clarity).

DETAILED DESCRIPTION OF THE EMBODIMENTS

The present invention shall generally be described with reference to FIGS. 1-5. One or more detailed embodiments of the present invention shall then be described with reference to FIGS. 6-9. It will become apparent to one skilled in the art that elements from one embodiment may be used in combination with elements of the other embodiments, and that the present invention is not limited to the specific embodiments described herein but only as described in the accompanying claims. Further, it will be recognized that the embodiments of the present invention described herein will include many elements that are not necessarily shown to scale.

Figure 1:
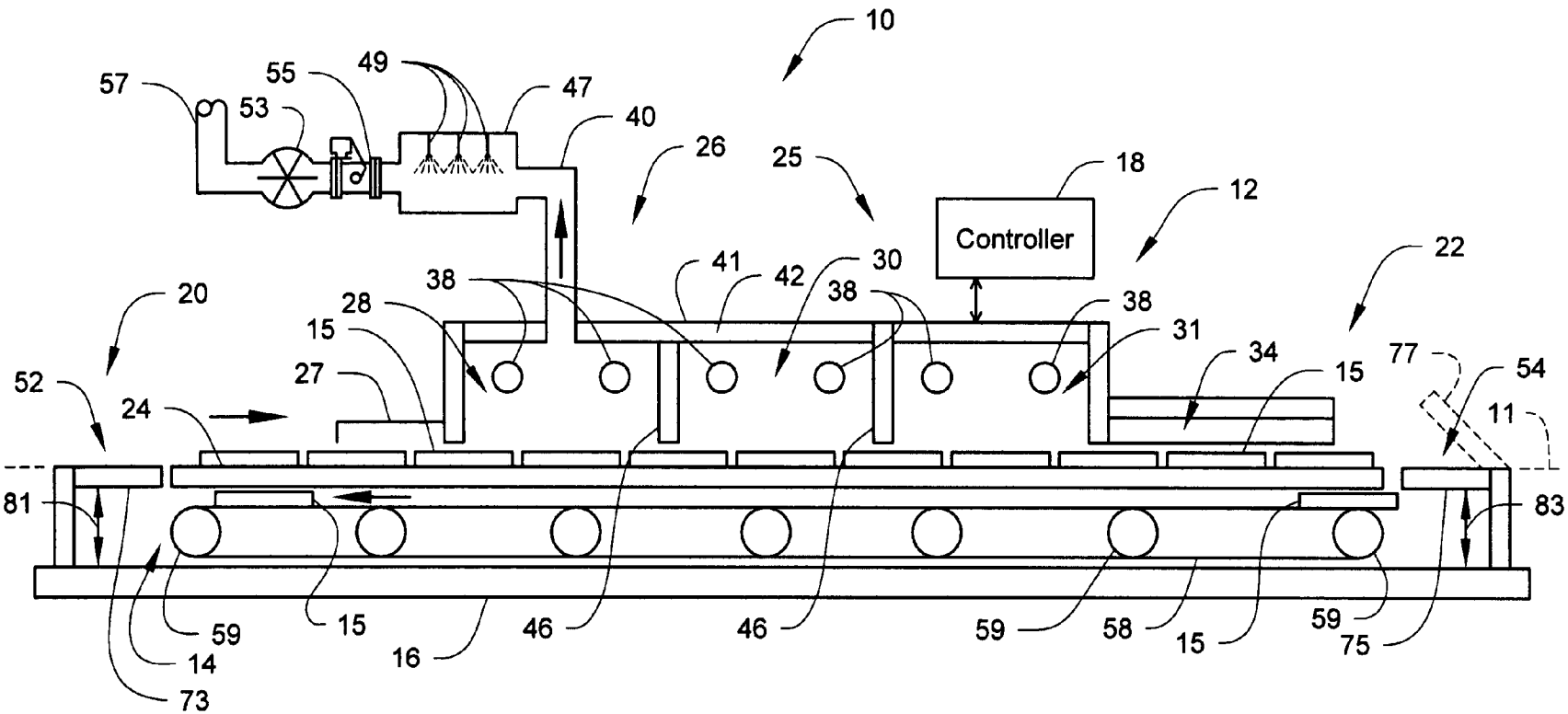
FIG. 1 is a generalized side cross-sectional diagrammatic view illustrative of a linear hearth furnace system according to the present invention.

FIG. 1 shows a side cross-sectional view of a linear hearth furnace (LHF) system 10 according to the present invention for use in processing raw material. The LHF system 10 includes a linear furnace apparatus 12 extending along a longitudinal axis 11 between a charging end 20 and a discharging end 22. The linear furnace apparatus 12 includes one or more zones 26 positioned along the longitudinal axis 11.

For example, the one or more zones 26 may include a feed zone 27 (e.g., a zone that provides a buffer zone ahead of high temperature zones so that containers are not inserted directly into such high temperature environments subjecting the container and the charge thereon to unacceptable thermal shock), a preheat zone 28 (e.g., a zone for drying raw material being processed or driving off undesirable volatile components of the raw material), a furnace zone 25 (e.g., reduction zone 30 and fusion/melting zone 31 operable to carry out a majority of the chemical reaction used in processing the raw material at relatively high temperatures), a cooling zone 34 (e.g., a zone used to cool resulting processed material before discharge), or any other zone necessary for performing the desired processing. One skilled in the art will recognize that any number of zones may exist between the charging end 20 and the discharging end 22 and that the zones 26 listed herein are only exemplary of the types of zones that may be used in accordance with the present invention.

The linear furnace apparatus 12 is configured to move one or more separate or separable containers 15 through at least the furnace zone 25 (e.g., reduction zone 30 and/or fusion/melting zone 31) to the discharging end 22 for use in processing the raw material received in the one or more separate or separable containers 15. The one or more separate or separable containers 15 are moved along longitudinal axis 11 of the linear furnace apparatus 12 using a container moving apparatus 24.

In addition to the linear furnace apparatus 12, the LHF system 10 includes a container return apparatus 14 operable to return one or more empty containers 15 to the charging end 20 of the linear furnace apparatus 12 to receive raw material for processing. The LHF system 10 further includes a discharge and transfer apparatus 54 at the discharging end 22 of the linear furnace apparatus 12 operable to discharge processed raw material from the one or more separate or separable containers 15 resulting in one or more empty containers 15 and provide the empty containers to the container return apparatus 14. A transfer apparatus 52 at the charging end 20 of the linear furnace apparatus 12 provides for transfer of the one or more empty containers 15 between the container return apparatus 14 and the container moving apparatus 24.

Figure 2:
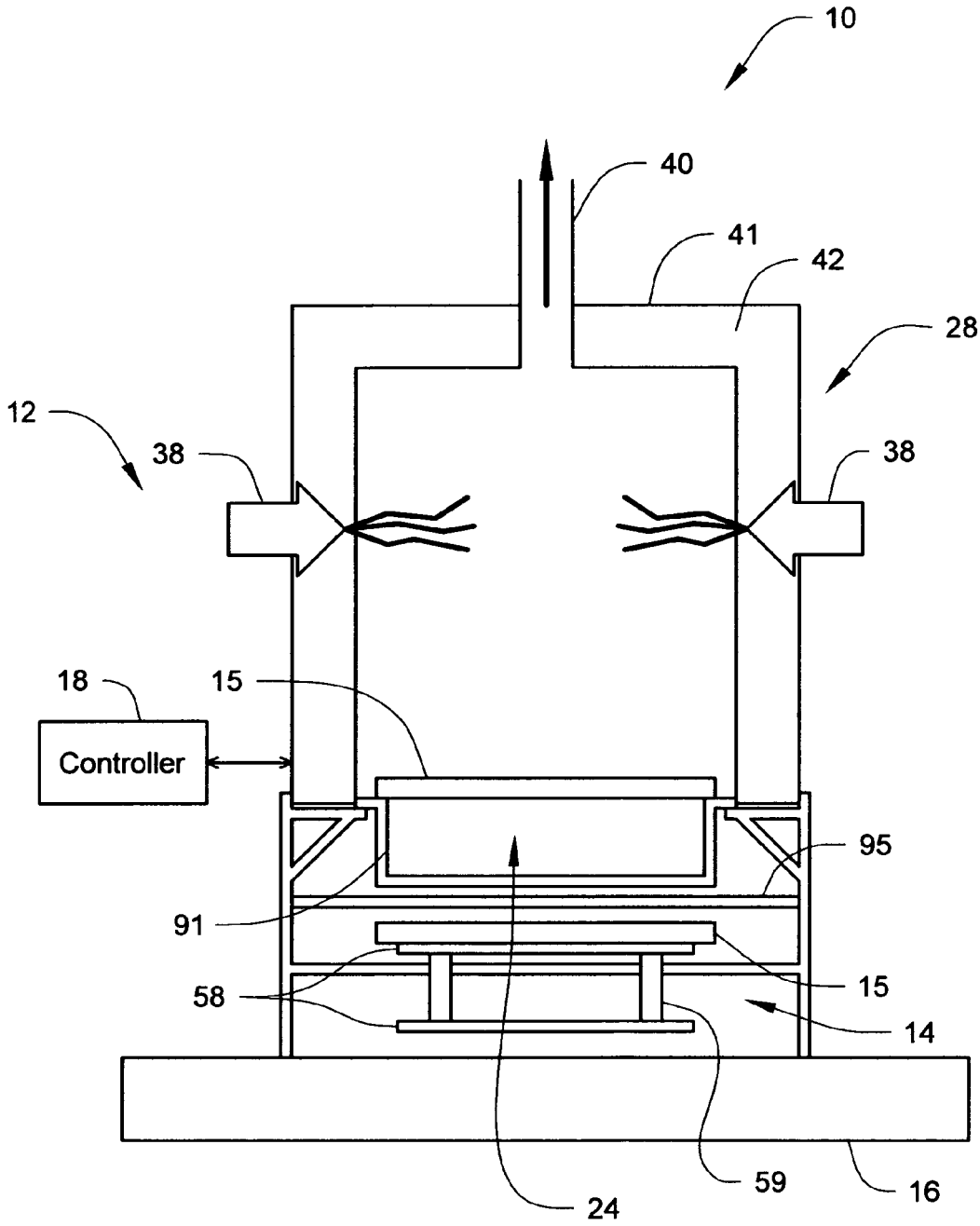
FIG. 2 is a generalized end cross-sectional diagrammatic view illustrative of the linear hearth furnace system shown generally in FIG. 1 according to the present invention.
Figure 3:
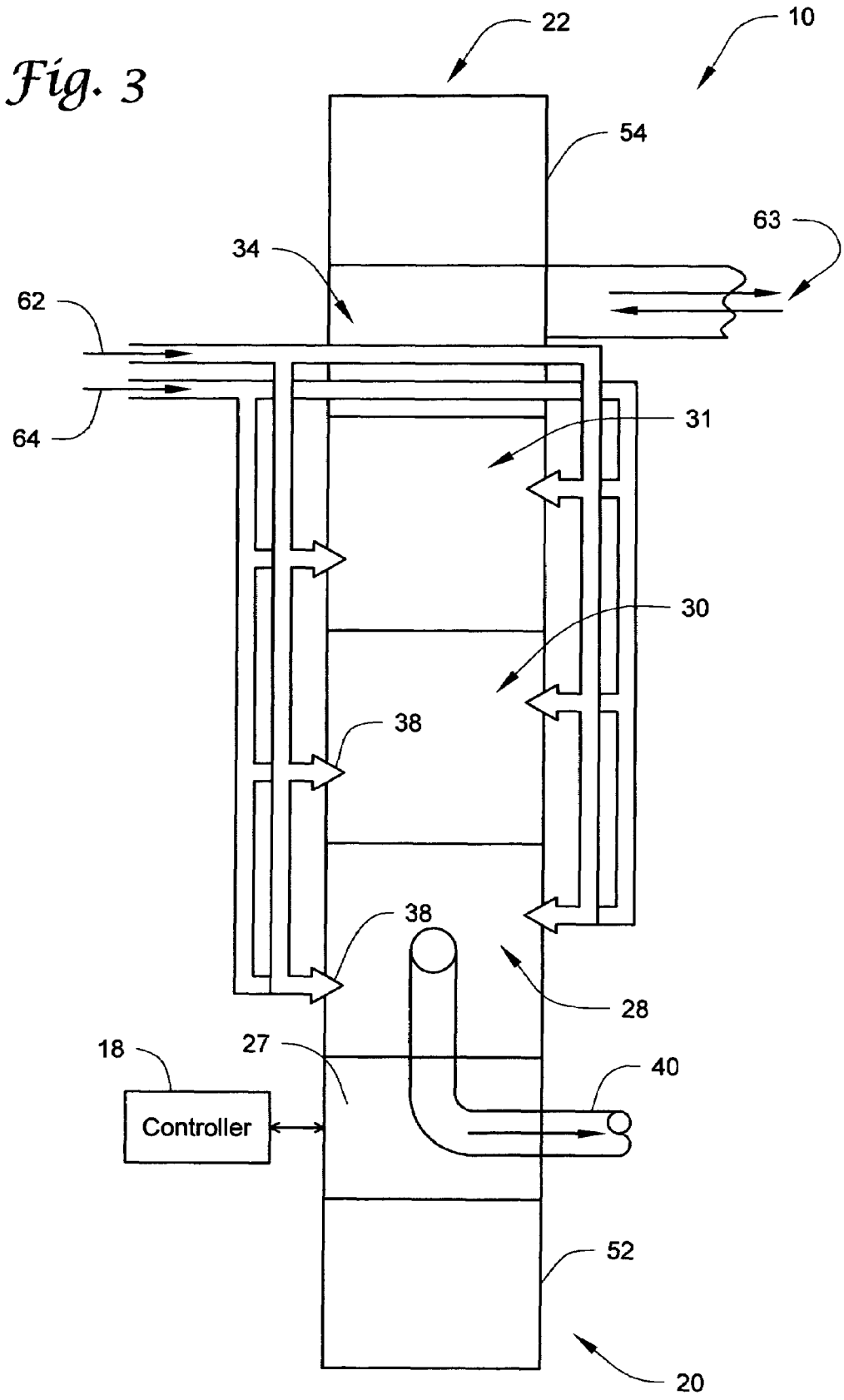
FIG. 3 is a generalized top plan diagrammatic view illustrative of the linear hearth furnace system shown generally in FIGS. 1 and 2 according to the present invention.

FIG. 2 shows a generalized end cross-section view of the LHF system 10 shown generally in FIG. 1. The cross-section is generally taken through the preheat zone 28. FIG. 3 shows a generalized top plan view of the LHF system 10 shown generally in FIG. 1. A controller 18 of the LHF system 10 shown in each of FIGS. 1-3 is utilized to control the LHF system 10. For example, the controller 18, shown only generally, may include any apparatus (e.g., hardware and/or software) necessary to control the performance of one or more various functions of the LHF system 10. For example, the controller 18 may control such functions as the speed of the container moving apparatus 24, the speed of the container return apparatus 14, the temperature of one or more of the zones 26, the timing and the transfer of one or more containers 15 from one type of moving apparatus to another, etc. One skilled in the art will recognize that the controller 18 may utilize one or more processing apparatus, sensors, actuators, etc., to carry out the processing of raw material through the LHF system 10 (e.g., the processing of iron bearing material in a direct reduction process).

In general, and as shown in FIGS. 1-3, the LHF system 10 is used to move one or more containers 15 from the charging end 20 to the discharging end 22 using the container moving apparatus 24. Thereafter, one or more empty containers 15 are returned from the discharging end 22 to the charging end 20 of the same linear furnace apparatus 12 using the container return apparatus 14.

Generally, the one or more separate or separable containers 15 may include any container configured for holding raw material to be processed by the LHF system 10. Preferably, the one or more separate or separable containers 15 include one or more separate or separable passive containers. As used herein, a passive container lacks self-mobility. For example, a passive container is one that lacks wheels or any other elements that allows the container to move on its own. For example, a wheeled cart or a wheeled container is not a passive container.

Each container 15 includes a refractory material upon which the raw material to be processed is received. The refractory material may be used to form the container (e.g., the container itself may be formed of a refractory material) and/or the container may include, for example, a supporting substructure that carries a refractory material (e.g., a refractory lined container such as with a refractory material being located or mounted within a container apparatus or a tray formed of a non-refractory material such as stainless steel).

In other words, for example, the container including the refractory material could be fabricated from a refractory material without a separate refractory material being provided in a supporting substructure. For example, the container 15 could be formed from a silicon refractory and, as such, would not need to be lined by a separate refractory material.

Figure 4:
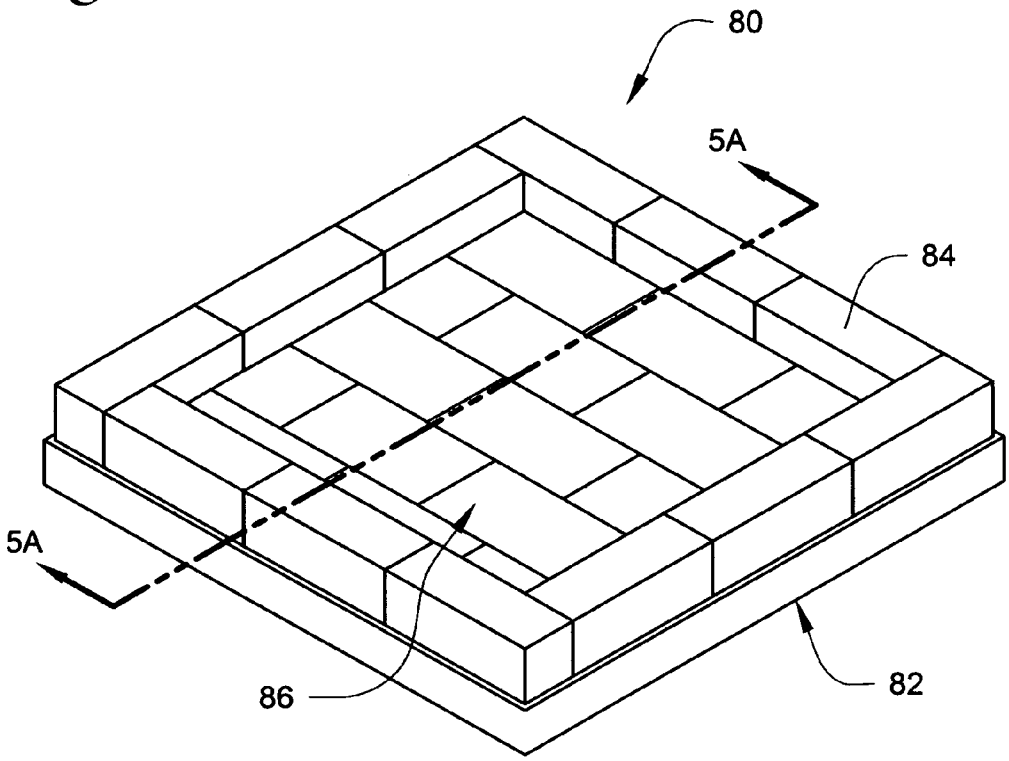
FIG. 4 shows a perspective view of one illustrative embodiment of a container that may be used with the linear hearth furnace system shown generally in FIGS. 1-3 according to the present invention.

One embodiment of a refractory lined container or substructure is shown in FIG. 4. The container 80 includes a tray 82 lined with refractory material 84 that defines a raw material receiving region 86. In other words, the container 80 includes a supporting substructure that carries a lightweight refractory bed on which the raw material 88 is placed. The support for the containers, while in transit through the furnace, at the discharging end 22, and throughout the return of the containers to the charging end 20, is such that the supporting substructure (e.g., tray 82) that carries the refractory does not require structural integrity due to the supporting substructure being essentially completely supported by the transport components of the system including, for example, the walking beams, side and center beams, transfer tables or rollers. With such support being provided throughout the process, the supporting substructure can be fabricated from lightweight materials and does not require massive structural design. This is unlike hearth sections that are supported by rollers at their ends.

In other words, the LHF system 10 includes a system of moving a container 15 of raw material 88 for processing through the linear furnace apparatus 12 using a container moving apparatus 24 and then back to the charging end 20 using a container return apparatus 14. The components of the container return apparatus 14, the container moving apparatus 24, and the transfer apparatus 52 and 54 are such that they provide uniform and continuous support as the containers 15 are moved from the charging end 20 to the discharging end 22 and then back again to the charging end 20. As such, the containers 15 themselves may be constructed in a manner that does not require structural integrity (e.g., they are continuously supported by other apparatus as they are moved).

Figure 5A:
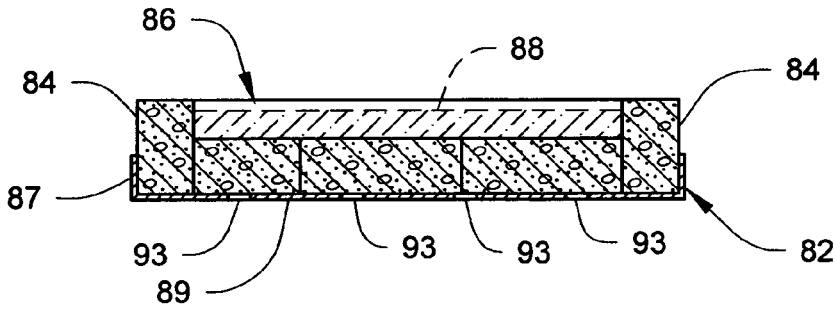
FIG. 5A is a cross-sectional view of the container shown in FIG. 4 taken at line 5A-5A with raw material being provided therein.

The supporting substructure or tray 82 may be formed from one or more different materials, such as, for example, stainless steel, carbon steel, inconel metal, or other metals, alloys, or combinations thereof, that have the required high temperature characteristics for furnace processing. Further, the tray 82 may be configured in one or more different shapes depending upon the configuration of the LHF system 10 or the configuration of one or more components thereof. For example, the container moving apparatus 24 may require that the tray 82 be of a particular configuration such that it can effectively move the container 80 along the longitudinal axis 11 of the linear furnace apparatus 12. As shown in FIGS. 4 and 5A, the tray 82 is constructed as a square tray including a bottom planar portion 89 and four side walls 87 extending from edges of the bottom planar portion 89.

FIG. 5A shows a cross-section of the container 80 along line 5A-5A of FIG. 4. As shown in this cross-section view, the bottom planar portion 89 includes defined openings 93 therein. Such defined openings may be shaped in any form, for example, any form that allows compensation for thermal expansion of the container, or substructure thereof, so as to minimize any tendency to distort the carrier as it is heated. For example, as show in FIG. 5A, the defined openings form slots in the bottom planar portion 89.

Like the tray 82, the refractory 84 may be formed in any configuration such that it defines the raw material receiving region 86 for receiving raw material 88 when used in conjunction with the tray 82. The refractory material may be, for example, refractory board (e.g., such as Thermotect A, Thermotect 80, or Thermotect HT available from Vesuvius USA, Bettsville, Ohio), refractory brick as shown in FIG. 5A, ceramic brick, or a castable refractory. Further, for example, as shown and described herein, a combination of refractory fiber board and refractory brick may be selected to provide maximum thermal protection for an underlying substructure container or tray, while maintaining a lighter weight for the tray.

Figure 5B:
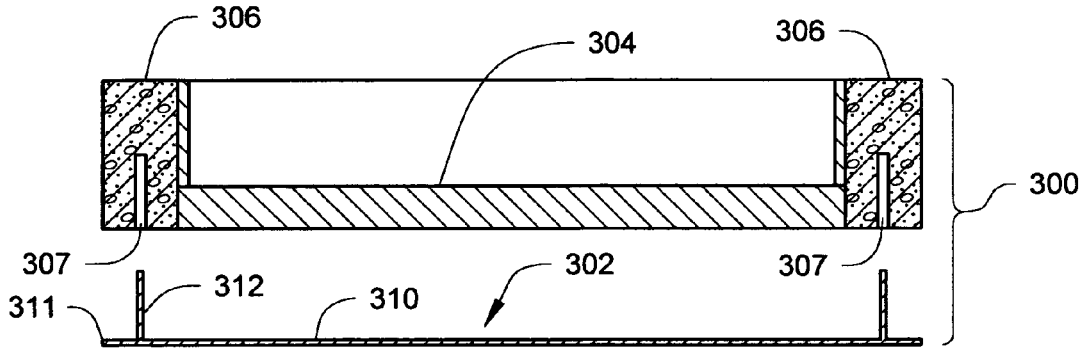
FIGS. 5B-5D are cross-sectional views of alternate containers to that shown in FIG. 4.

FIG. 5B shows a cross-section of an alternate configuration of an exemplary container 300. As shown in this cross-section view, an underlying substructure 302 includes a bottom planar portion 310. Four side walls 312 extending orthogonal from the bottom planar portion 310 are located a distance from the edge 311 of the bottom planar portion 310. With use of such an underlying substructure 302, refractory material (e.g., refractory material 304 and 306) may be used to cover the entire upper and generally exposed portions thereof. For example, as shown in FIG. 5B, refractory brick 306 (e.g., andalusite brick) having a slot 307 defined therein for mating with the side walls 312 is used to cover the side walls 312 and portions of the substructure 302 (e.g., portions proximate the edge 311 thereofl. Further, as shown in FIG. 5B, a refractory fiber board 304 is used to cover the majority of the underlying substructure 302 (e.g., interior of the side walls 312) and also portions of the refractory brick 306 facing to the interior of the container 300 where raw material 88 is received for processing.

Figure 5C:
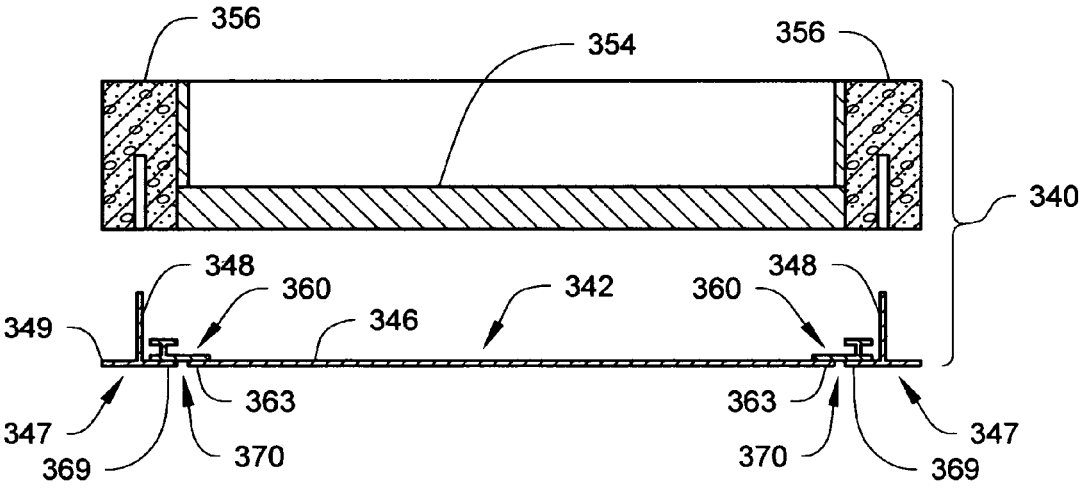

FIG. 5C shows a cross-section of another alternate configuration of an exemplary container 340 for receiving raw material 88 for processing. As shown in this cross-section view, the underlying substructure 342 is similar to substructure 302 of FIG. 5B, but includes a floating bottom planar portion 346 supported by a continuous angle frame 347 including the four side walls 348 extending orthogonal therefrom and at a distance from edge 349 of the substructure 342. Mechanical coupling of the floating bottom planar portion 346 to the continuous angle frame 347 is accomplished, at least in one embodiment, by coupling element 360 which is attached to the edge 363 of the floating bottom planar portion 346 which supports the floating bottom planar portion 346 on and interior edge 369 of the continuous angle frame 347. Therefore, a gap 370 is provided between the floating bottom planar portion 346 and the continuous angle frame 347 which allows for thermal expansion and relative motion between such components. The refractory material (e.g., refractory material 354 and 356) used to cover the entire upper and generally exposed portions of the underlying substructure 342 is substantially the same as that shown in FIG. 5B. One skilled in the art will recognize from the description herein that the underlying substructure may be formed of any number of portions or sections that are movable relative to one another or allow for expansion of the portions or sections.

Figure 5D:
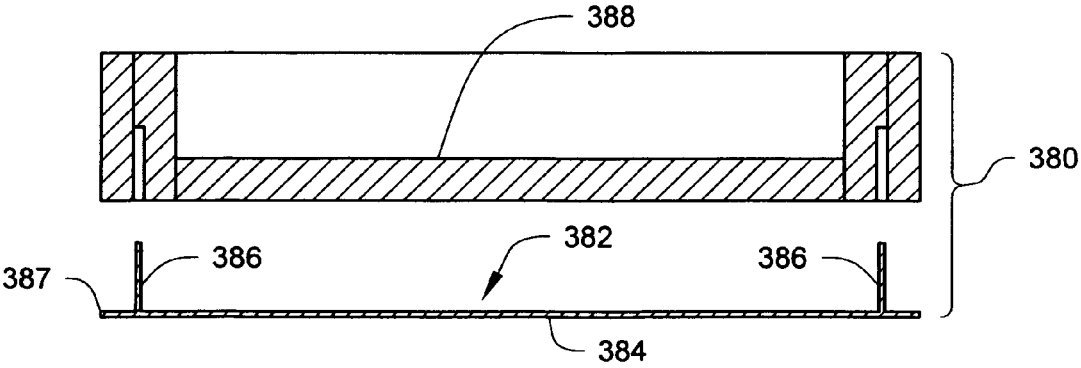

FIG. 5D shows a cross-section of yet another alternate configuration of an exemplary container 380 for receiving raw material 88 for processing. As shown in this cross-section view, the underlying substructure 382 is substantially similar to substructure 302 of FIG. 5B and includes bottom planar portion 384 and four side walls 386 extending orthogonal therefrom and at a distance from edge 387. However, as shown in FIG. 5D, the refractory material 388 used to cover the entire upper and generally exposed portions of the underlying substructure 382 is entirely formed of refractory fiber board.

As used herein, the term separate when describing containers refers to containers that are completely separated at all times. Further, as used herein, the term separable when describing containers refers to containers that are at least completely separable from each other at the charging end 20 and/or the discharging end 22 of the LHF system 10. In other words, in one embodiment, the containers include separable containers that are mechanically linked together to prevent shifting and separating from each other as they are transported through the furnace, but then completely separable at the discharging end 22 of the LHF system 10 for discharge and return to the feed end of the furnace. In another embodiment, the containers include separate containers that are completely separate at all times. However, whether completely separate at all times or completely separable only at the charging end 20 and discharging end 22, each container 15 can be discharged and returned to the charging end 20 for provision of raw material 88 therein. Further, the container 15 may be inspected and, if in a failure mode, removed and a new container 15 installed without affecting furnace operation. This is contrary to a RHF system, wherein a hearth failure requires complete shutdown of the entire system.

The technique of using containers 15, according to the present invention, in the LHF system 10 is substantially different than in a RHF system. In a RHF system, a massive refractory ring is carried on a series of tracks. It must be relatively thick to provide sufficient mass to protect the supporting tracks and bearings from the furnace temperatures. Generally, the RHF system is in continuous service and only slightly cooled as it passes through the cooling and loading zones.

In contrast, the containers in the LHF system 10 are preferably provided such that they carry a relatively thin, lightweight refractory bed that is supported in a metal container (e.g., substructure or tray as described above), at least in one embodiment of the present invention. The retention time of the container in the linear furnace apparatus 12 is relatively short, for example, only about 10 minutes in the high temperature zone for a direct reduction process (e.g., in reduction zone 30 and fusion/melting zone 31). The relatively light refractory load also results in a thermal capacity of the containers being relatively low such that they will cool rapidly in the cooling and discharging stages of a direct reduction process, and during a return to the charging end 20 of the linear furnace apparatus 12, such containers are cool enough to accept wet or dry agglomerate.

The cross-section of FIG. 5A shows the addition of a raw material 88 being received within the raw material receiving region 86. One will recognize that the raw material 88 may be provided into the container 80, or any other container according to the present invention, in any manner or form. For example, the raw material 88 may be in the form of balls, powdered material, multiple layers, or any other endless number of different configurations for the effective processing of the raw material 88.

The raw material 88 may be any material suitable for processing by the LHF system 10. Preferably, the raw material 88 includes an iron bearing material. In one embodiment of the present invention, the raw material 88 includes an iron bearing material (e.g., iron oxide material) and a carbonaceous material (e.g., a carbonaceous reductant such as coal, charcoal, or coke). Further, the raw material may include other additives to enhance the physical characteristics of wet or dry agglomerates (e.g., green balls prepared from the blended components) or mixtures charged in the containers and other additives to facilitate reduction of the iron oxide material and control the chemistry and physical characteristics of the associated slag phases during processing.

In other words, generally, according to the present invention, the raw material 88 fed to the LHF system 10 (e.g., to the raw material receiving region 86 defined by container 80) may be any material suitable for processing by the linear furnace apparatus 12 and is not restricted by any components listed herein. However, preferably, at least in one embodiment, the raw material 88 includes at least an iron bearing material (e.g., iron oxide material, iron ore concentrate, recyclable iron bearing material, etc.) such that metallized iron product or metallic iron nuggets are formed after a direct iron reduction process is carried out using the LHF system 10.

As will be recognized by one skilled in the art, the raw material 88 will depend at least in part upon the processing to be performed by the LHF system 10. For example, appropriate and suitable raw material will vary for the production of fired pellets, fluxed pellets, conventional DRI pellets, prereduction of steel plant wastes, and the production of metallic iron nuggets, as well as for products formed by other high temperature furnace applications, such as calcining of carbonate fluxes, thermal treatment of bloating clays, firing of clay-rich industrial waste products from paper mills, singly or in combination with power plant ash to produce light weight aggregate.

In yet another embodiment, according to the present invention, the raw material 88 may be any material used or operated on by a rotary hearth furnace (RHF). In other words, the same type of raw materials may be used, according to the present invention, in the LHF system 10 as used in RHF systems.

In particular, the LHF system 10 is beneficial in production of metallic iron nuggets using direct reduction processing techniques. As such, a substantial portion of the remaining description shall be with respect to the use of the LHF system 10 and any embodiments thereof for direct reduction processing. However, the present invention is not limited to only direct reduction processes, but may be used to process any other suitable raw materials.

With further reference to FIGS. 1-3, at the charging end 20 of the LHF system 10, the transfer apparatus 52 is configured to move an empty container 15 from the container return apparatus 14 to the container moving apparatus 24. The configuration of the transfer apparatus 52 will, at least in part, depend upon the configuration of the container return apparatus 14 and the container moving apparatus 24 and their relative location with respect to one another. The transfer apparatus 52 may include any configuration suitable for moving the empty container 15 to a location for accepting raw material 88, and thereafter, allowing the filled container 15 to be provided to the container moving apparatus 24 such that it can be moved through the one or more zones 26 of the linear furnace apparatus 12.

For example, the transfer apparatus 52 may include one or more of the following: hydraulic or mechanical lift and pushing mechanisms, ball bearing roller transfer tables, centering and alignment guides, mechanical linkages for automatic opening and closing of charging doors, electronic sensors and actuators to control related operations. One embodiment of a transfer apparatus 52 is shown and shall be described with reference to FIGS. 6-8.

Generally, as shown in FIG. 1, the container return apparatus 14 is positioned directly below the container moving apparatus 24, as well as other portions of the linear furnace apparatus 12. As such, the transfer apparatus 52 is configured as a lift and lowering mechanism represented by arrow 81 to assist in moving a container transfer device 73, and a container 15 provided thereon, between the container return apparatus 14 and the container moving apparatus 24.

At the discharge end 22, as shown in FIG. 1, the discharge and transfer apparatus 54 provides a discharge apparatus 77 for discharging processed material from one or more of the containers 15 resulting in one or more empty containers 15. The discharge apparatus 77 may be any mechanism effective for providing discharge of processed material resulting from the processing performed by the LHF system 10. For example, the discharge apparatus 77 may include mechanisms for removing processed material with use of gravity, mechanical removal of processed material (e.g., using wipers, blades, rotary screw devices, or other mechanical elements for contacting and moving the processed material), etc.

In one embodiment, discharge of processed material from the one or more containers 15 employs the tilting of one or more containers 15 at an angle effective for allowing the processed material to slide off the containers 15 using gravity. As will be discussed further herein, the cooling zone 34 of the linear furnace apparatus 12 allows sufficient time for complete solidification of fused processed material in the form of, for example, metallic iron nuggets before they are dumped with the use of gravity, resulting in the clean discharge of processed material from the containers 15.

However, other mechanical assist devices may be used in combination with gravity if or as required to facilitate such a clean discharge of processed material. For example, vibration as well as other mechanical elements for scraping or pushing processed raw material from the containers may be used. Such mechanical assist devices may be used for removal of any material that, for example, sticks to the container before the empty container 15 is returned to the charging end 20 of the LHF system 10.

The transfer apparatus 54 also includes a container transfer device 75 for moving an empty container 15 after processed material is discharged therefrom to the container return apparatus 14. As described with reference to the container transfer device 73, the container transfer device 75 may include any transfer mechanism effective for transfer of the empty container 15 to the container return apparatus 14 and will depend, at least in part, on the general construction and relative location of the container moving apparatus 24 and the container return apparatus 14. For example, one or more various mechanisms such hydraulic or mechanical lift and pushing mechanisms, ball bearing roller transfer tables, centering and alignment guides, mechanical linkages for automatic opening and closing of doors, electronic sensors and actuators to control related operations, powered rollers, passive rollers, centering rollers, etc., may be used to perform such functionality.

In one embodiment, as generally shown in FIG. 1, where the container return apparatus 14 is directly positioned below the container moving apparatus 24, and also other components of the linear furnace apparatus 12, the container transfer device 75 may include a lift and lowering mechanism to perform such functionality, as shown generally by arrow 83. Other mechanisms may be used to provide an effective transfer of the empty containers 15 to the container return apparatus 14, such as that described with reference to FIGS. 6-8.

Upon receipt of the raw material 88 into one or more separate or separable containers 15 at the charging end 20 of the linear furnace apparatus 12, the one or more containers 15 are provided to the container moving apparatus 24 for movement along longitudinal axis 11 through the one or more zones 26 of the linear furnace apparatus 12. One skilled in the art will recognize that the one or more zones 26 will depend upon the processing necessary for the raw material 88. However, generally, in one or more embodiments of the linear furnace apparatus 12, the one or more zones 26 include at least the preheat zone 28, a furnace zone 25 (e.g., one or more zones wherein a substantial portion of a chemical reaction takes place to modify the properties of the raw material, such as a reduction zone 30 and the fusion/melting zone 31), and a cooling zone 34, all positioned along the longitudinal axis 11 between the charging end 20 and the discharging end 22.

One or more of the zones 26 may be configured using multiple modular linear sections corresponding to the particular zone being configured in order to allow lengthening or shortening of the at least one zone along the longitudinal axis 11. For example, the preheat zone 28 may be lengthened by adding sections configured for preheating raw material (e.g., sections that are all constructed in substantially the same manner and configuration).

In one embodiment, the LHF system 10 is constructed with a series of identical modules with required burners, gas and air connections, off-gas ports, etc., such that the LHF system 10 may be easily constructed at effective costs. Such a modular construction will facilitate furnace repair if failures occur therein, for example, a refractory failure in one or more portions thereof.

Further, one or more of the zones 26 may be divided into sub-zones by one or more baffle structures 46. For example, the furnace zone 25, as shown in FIG. 1, is divided into the reduction zone 30 and the fusion/melting zone 31 by a baffle structure 46. Further, the various zones, such as the preheat zone 28 and the furnace zone 25, may also be separated by a baffle structure 46. Zones which are divided into sub-zones with appropriate baffle structures 46 may allow closer control of temperature and furnace gas distribution. However, such baffle structures (e.g., baffle structures creating sub-zones or those between zones) are only optional as processing may be carried out in a furnace that has no baffle structures (e.g., temperature may vary within the zone, but movement of gases in the zone is continuous and not hindered with baffle structures).

The linear furnace apparatus 12 is a counter flow design in that the gas flow is counter to the movement of the containers 15 and process material therein. The combustion gases produced by burners 38 in all three zones 28, 30, and 31, combined with water vapor, organic volatiles, flux calcinations products, and chemical reaction products eventually exit the furnace via flue 40. In other words, discharge flue 40 is the primary process flue. In at least one embodiment of the present invention, eventually, all gases, combustion products, water vapor, volatiles from coal or fluxes, and reaction products exit the process through discharge flue 40. However, internal recycling between the principal zones of the furnace 12 (e.g., zones 28, 30, and 31) is allowed (e.g., such as with use of additional flues or conduits).

A quench chamber 47 is connected in-line with the exit flue 40 and is equipped with water sprays 49 to cool the discharge (e.g., gases) flowing therethrough. Further connected in-line with the discharge flue 40 is a pressure control valve 55 and a variable speed exhaust fan 53 that vents the cooled gases to a discharge stack 57. The variable speed exhaust fan 53 in conjunction with the pressure control valve 55, at least in this embodiment, is used to control the pressure inside the linear furnace apparatus 12 using conventional pressure sensors and feedback control technology to control the infusion of ambient air into the linear furnace apparatus 12 (e.g., with use of controller 18).

It will be clear that exhausting hot gases from the furnace apparatus 12 can be implemented in various different manners to remove particulates and recuperate heat energy. The above description is only one exemplary embodiment of providing such exhausting of the hot gases.

Yet further, the linear furnace apparatus 12 may include one or more conduits (e.g., similar to flue 40) to allow movement of one or more gases between the preheat zone 28, the furnace zone 25, or sub-zones thereof. The conduits or flues may be incorporated into the system to allow bypass of portions of the furnace gases between zones to facilitate chemical reactions.

With yet further reference to FIGS. 1-3, the container moving apparatus 24 for moving the containers 15 through the zones 26 positioned along the longitudinal axis 11 of the linear furnace apparatus 12 may be configured in any manner suitable for providing movement of the containers 15 from the charging end 20 to the discharging end 22. The container moving apparatus 24 is shown generally in FIG. 2 as being sealed using a structural enclosure 91 to represent that the container moving apparatus 24 is, preferably, a substantially mechanically sealed apparatus such that gases in the zones 26 are retained therein and unacceptable infiltration of ambient air into such zones 26 is prevented.

As used herein, substantially mechanically sealed means that the only openings to the linear furnace apparatus 12 include an inlet opening into the linear furnace apparatus 12 (e.g., where a container 15 is received into the linear furnace apparatus 12 at feed zone 27) and an outlet opening at the discharge end of the furnace apparatus 12 (e.g., at the end of the cooling zone where a container is provided to the transfer apparatus 54), and that both inlet and outlet are fitted with sealed doors that are only opened as required to allow the insertion or ejection of containers from the furnace thereby minimizing infiltration of ambient air therein. For example, as described herein such inlet and outlet may include closure apparatus (e.g., see closure apparatus 129 of FIG. 6B) that opens only when necessary (e.g., such that a container can be moved therethrough) so as to minimize the infusion of ambient air into the furnace or gases from escaping from the interior of the furnace.

Various container moving apparatus 24 may be used to move the separate or separable containers 15 through the linear furnace apparatus 12 (e.g., steel belt systems, continuous chain, rollers, linked insulated pads, walking beams, or by sliding the containers on fixed rails). In one embodiment according to the present invention, the container moving apparatus 24 includes a walking beam configuration. As used herein, the term walking beam configuration refers to any apparatus that is operable to lift and shift forward the trays or containers 15 through the linear furnace apparatus 12 along the longitudinal axis thereof.

One embodiment of such a walking beam configuration is shown and shall be described with reference to FIGS. 6-8. As shown therein, each of the one or more containers 15 is supported by one or more transport beams of the walking beam configuration as the containers 15 are moved along the longitudinal axis 11 of linear furnace apparatus 12 and through one or more of the zones 26. Preferably, one or more transport beams include an insulating material in contact with one or more of the containers 15, and the walking beam configuration is substantially mechanically sealed.

In other words, the LHF system 10 provides for effective sealing of the linear furnace apparatus 12 to prevent the unacceptable infiltration of ambient air into one or more zones 26 thereof. Generally, as described previously herein, the linear furnace apparatus 12 is designed as a substantially mechanically sealed unit (e.g., with walking beam configuration or other transporting system being enclosed within the sealed furnace). Ingress of air is limited to the feed inlet at the charging end 20 and the outlet at the discharging end 22 of the linear furnace apparatus 12. Such inlet and outlet of the linear furnace apparatus 12 are configured to minimize the amount of ambient air reaching the interior of the zones 26. For example, various doors, curtains, or other structural impediments to the movement of air into one or more of the zones 26 are utilized at the charging end 20 and discharging end 22 of the LHF system 10.

The container return apparatus 14 used to return the empty containers 15 from the discharging end 22 to the charging end 20 of the linear furnace apparatus 12 may include any suitable transfer apparatus that accomplishes such functionality. For example, and as shown in FIG. 1, the container return apparatus 14 may include a belt 58 and rollers 59 configuration powered to provide a return of the empty container 15 to the charging end 20. Further, for example, the container return apparatus 14 may be an apparatus as described herein with reference to FIGS. 6-9. Yet further, the container return apparatus 14 may be configured as continuous chains, steel cables, or a transport cart (e.g., a transport cart such as described with reference to FIG. 9) to deliver the containers singly or as linked container pods back to the charging end 20 of the furnace (e.g., the transport cart is then returned to the discharging end 22 to receive another load of one or more containers). Such a cart may be driven by a cable arrangement, motor driven cog wheel, or similar drive mechanism. One or more transport carts could be paired so that containers can be loaded and discharged simultaneously at each end to facilitate movement of the containers.

Preferably, the container return apparatus 14 provides for the immediate return of the one or more empty containers 15 to the charging end 20 of the linear furnace apparatus 12. As used herein, the term immediate refers to the return of the empty container 15 to the charging end 20 with no time spent at a location for additional cooling or other processing steps.

The container return apparatus 14 is also preferably configured to return the empty container 15 to the charging end 20 in an upright state. In other words, preferably, the transfer apparatus 54 provides for the transfer of the upright and emptied containers 15 (i.e., after being discharged by discharge apparatus 77) to the container return apparatus 14 in an upright state. This upright state is maintained as the empty containers 15 are moved to the charging end 20. As such, for example, refractory material lining the trays is maintained in its desired position and is not lost during return of the container to the charging end 20.

In one embodiment of the present invention, one or more of the empty containers 15 may be removed from the container return apparatus 14. The empty containers 15 may or may not be replaced with a different empty container 15. For example, the empty containers 15 may be removed as required for repair and maintenance.

As shown in FIG. 2, the linear furnace apparatus 12 and the container return apparatus 14 may be separated by a heat shield material 95 (e.g., material such as mild steel, ceramic refractory, or refractory fiberboard). The heat shield material 95 provides for additional separation of the hot linear furnace apparatus 12 from the container return apparatus 14, which is located directly below the linear furnace apparatus 12. The LHF system 10 is positioned and supported on a suitable pad 16 (e.g., concrete).

As shown generally in FIGS. 1 and 2, the zones 26 may be defined by walls 41 formed from a wall material (e.g., steel, refractory brick, castable refractory, insulating fiber blocks or board, or combinations thereof). Generally, an insulating material 42 is used to line the walls 41 to retain heat. For example, such insulating material 42 may include steel plate, insulating fiber block, or refractory bricks or castable refractory.

One or more of the zones 26 are provided with temperature modification apparatus 38. Such temperature modification apparatus 38 may include gas burners, as shown generally in FIGS. 1-3, where natural gas 62 and combustion air 64 are provided to such gas burners located in individual zones or sub-zones. Depending on the zones, for example, the temperatures maintained therein may be between 1,000-3,000° F. Although gas burners are shown generally in FIGS. 1-3, other types of temperature modification apparatus 38 may also be used, including, for example, electric heating apparatus or off-gas combustion burners.

Various processing advantages may be available using one or more embodiments of the LHF system 10 according to the present invention. Such advantages are described with respect to various steps employed for processing the raw material using the LHF system 10, with some comparison to previously available RHF systems. Further, such advantages are described with respect to direct reduction processes of iron bearing material, but may be equally applicable to other furnace processing.

Generally, a raw material is fed to the LHF system 10 in a direct reduction process. For example, the raw material may include iron ore concentrate or other iron bearing material; a carbonaceous reductant such as coals of various grades including coal, charcoal, or coke; fluxing agents such as lime or lime hydrate; a binding agent to aid agglomeration such as bentonite or lime hydrate; and water. One skilled in the art will recognize that this is an illustrative type of raw material and does not limit the types of materials with which the LHF system may be used. Further, for example, the raw material provided in the process may be in the form of green balls prepared from a blend of components such as components selected from those described above, or may be provided by providing one or more layers of a blend of one or more of such components, or of the components themselves.

The requirements for mixing and blending the desired components in proper proportions will vary depending upon other parameters required to carry out the direct reduction processing. One will recognize that any number of direct reduction processing parameters and techniques may be carried out using the LHF system 10, and that the present invention is not limited to any particular direct reduction process. Many of such processes are described in the art and as such will not be described in great detail herein. However, the various steps that may benefit from the use of the LHF system 10 shall be described.

Drying of the raw material 88 is generally necessary. For example, mixing and blending of the raw material 88 is normally performed in a wet state (e.g., the blend may contain from 5-15% moisture). If the raw material 88 is agglomerated (e.g., either formed into balls or briquettes), then the agglomerates have to be dried under carefully controlled conditions to avoid decrepitation, loss of integrity of the agglomerates, and release of excess dust.

In conventional RHF systems, normally an external system is used to form the agglomerates and the agglomerates are then transferred to the RHF furnace for direct reduction processing. Such dried agglomerates are inherently fragile and cannot be readily conveyed to feed hoppers as breakage occurs in both roller and vibrating feeders. Such breakage is generally overcome by adding excessive amounts of binders, such as bentonite, or by adding lime and using extended heat treatment to develop a carbonate bond, or by other pre-treatment methods. Such additions are costly and, also, in the case of bentonite, such additions add unwanted slagging components to the mix that require additional fluxing agents and thermal energy to process.

Charging a "green" ball (e.g., a non-dried agglomerate), compared to a dried agglomerate, is much easier. The non-dried agglomerates can absorb multiple transfers without excessive breakage or dusting and can be more easily transferred to the furnace. However, drying of such green balls in a RHF is problematic in that there is a practical limit to the hearth diameter, and, if a portion has to be reserved for drying, then it has an adverse effect on productivity related to the final product. Further, in the RHF, the hearth itself is massive and reaches very high temperatures in the final fusion zone in direct reduction processing. Such high temperatures would still be too high at the feed point in an RHF to accept wet agglomerates without excessive decrepitation.

According to the present invention, the LHF system 10 overcomes such problems of a RHF system. First, the containers 15 are designed to be comparatively light with relatively low heat capacity so that by the time they have been discharged at the discharging end 22 and returned to the charging end 20, the empty containers 15 have cooled to the point that wet agglomerate feeding of raw material 88 is acceptable.

Second, the preheat zone 28 can be easily implemented in the LHF system 10 by merely adding length to the linear furnace apparatus 12. For example, by enclosing a section of space and allowing latent heat in the containers 15 to dry the wet agglomerate provided therein, such a preheat zone may be implemented. As previously described herein, the preheat zone 28, or a drying zone, may be added in modular sections depending upon the necessary drying requirements. In other words, there are no restrictions on length of the preheat zone, unlike the RHF.

Third, drying in the preheat zone 28 may be accomplished using off-gases from one or more of the other zones 26. For example, if necessary or desirable, a portion of the hot off-gases from the direct reduction process in the furnace zone 25, or a sub-zone thereof, can be circulated through the preheat zone 28 to expedite the drying process.

With respect to the loading of the linear furnace apparatus 12, preferably, the raw material 88 provided to the furnace is distributed uniformly across the width of the furnace to achieve efficient reduction and maintain productivity. The LHF system 10 allows the use of off-the-shelf feeding components and minimizes distribution problems therein. For example, such off-the-shelf feeding components may include roller, vibrating, oscillating belt or apron belt feeders. In contrast, a RHF system must deal with the differential movement between inner and outer portions of the circular hearth that make uniform feed distribution more difficult.

The LHF system 10, according to the present invention, can duplicate any time/temperature thermal cycle currently used in a RHF system. For example, the linear furnace apparatus 12 can be divided into as many zones 26 as required (e.g., by providing various temperature differences across one or more zones, and/or by installation of optional baffle structures 46). The recycling of off-gases from one zone to another can be controlled as easily in one as the other. In other words, the thermal cycling in the preheat zone 28, reduction zone 30, and fusion/melting zone 31 for performing a direct reduction process (e.g., a metallic nugget formation process) can easily be controlled in the LHF system 10 according to the present invention.

Further, the linear furnace apparatus 12 is preferably designed such that the distribution of temperature modification apparatus 38 (e.g., gas burners) is symmetrical. This is generally shown in FIGS. 2 and 3, wherein each zone 26 is provided with a symmetrical number of gas burners on each side of the linear furnace apparatus 12. As such, the LHF system 10 provides a significant advantage over a RHF system where the positioning of burners to achieve uniform heating across a 3-4 meter wide bed is more difficult because of the differential between the linear velocity of the inner and outer edges of the RHF system. A direct reduction process generally requires closely controlled time and temperature as the raw material is moved through the processing zones. Such control is provided, at least in part, by the symmetrical distribution of the burners (e.g., the symmetrical burners having the ability to apply uniform thermal energy input into the zones of the LHF system 10) as is readily achieved by the linear design of the LHF system 10.

At least in one embodiment, upon reduction of the raw material in the reduction zone 30, and further melting/fusion in the zone 31, a resulting processed material is provided in the container 15 as it moves into the cooling zone 34. The resulting product of the direct reduction process using the LHF system 10, whether it be a metallic iron nugget or other product resulting from a direct reduction process, in many instances, needs to be protected from re-oxidation until it is cooled enough to be handled under ambient conditions. For example, in many conventional direct reduction processes, metalized pellets are formed which are easily oxidized. Although an iron nugget direct reduction process produces a metallic iron nugget that is quite resistant to oxidation, generally, it may still be necessary to provide a cooled, processed material. Further, metallic iron nuggets formed using direct reduction processes also must be chilled enough to solidify before they can be discharged at the discharging end 22 of the linear furnace apparatus 12.

A RHF system has a cooling or chilling zone at the end of the cycle, wherein a water jacket is used to cool the processed material on a bed thereof to an acceptable level for discharge. This is an additional constraint for the RHF system because the area required for cooling has a direct effect on the area of the RHF system that can be used for producing product. Generally, product in a RHF system is discharged with minimal cooling and transferred to an external cooling system under a controlled atmosphere to prevent oxidation. In other words, cooling completely on the hearth of a RHF system is generally not practical.

Quite in contrast, the LHF system 10, according to the present invention, can be easily and economically extended to provide sufficient cooling so that the processed material can be discharged with minimal concern for re-oxidation and significantly reduce product handling problems, cost, and maintain product integrity.

If the processed material of the linear furnace apparatus 12 is conventional metalized pellets, they will generally have a tendency to re-oxidize if they come into contact with air while they are too hot. The extension of the cooling zone 34 in a LHF system 10 is relatively inexpensive. It can be lengthened to provide enough time for product to cool to the point where the resulting processed product is no longer pyrophoric. Lower product discharge temperatures also simplify downstream handling problems.

If the processed material is in the form of metallic iron nuggets, extended cooling on the hearth may be provided to allow direct screening of the product to remove slag and carbonaceous hearth material for recycling, or such cooling may be sufficient when the raw processed material is cooled to the point where water quenching may be applied.

The cooling section 34 of the linear furnace apparatus 12 may be configured in any manner such that it is suitable for performing the cooling function for the processed material passing therethrough (e.g., the length may be extended to provide adequate cooling). For example, the cooling zone 34 as shown in FIG. 3 may be provided with water or another suitable fluid 63 to remove heat from the zone 34. For example, preferably, a water jacket is used to provide suitable cooling. Such water jackets are readily known to those skilled in the art and, as such, are not described in detail herein. Further, for example, the cooling zone 34 may utilize other techniques for cooling such as discharging the hot charge (e.g., processed material) into a sealed container purged with an inert gas such as nitrogen, or discharging the hot charge into an indirect rotary cooler and then returning the empty container to the charging end 20 of the furnace.

Discharging processed material from a conventional RHF system is usually accomplished using, for example, a water-cooled rotary screw. If the processed material is uniformly-sized metalized pellets or briquettes and is completely solidified, a rotary screw can perform flawlessly. However, if the product contains agglomerates and if coalesced, or semiliquid slag phases are present that will adhere to the screw or pile up on the hearth where it may cause discharge problems.

In contrast, the discharge of processed material from the containers 15, according to the present invention, may be accomplished, at least in one embodiment, by tilting the containers 15 at a high angle and allowing the processed material to slide off. By having an effective cooling zone 34 (e.g., a cooling zone not constrained in length due to the linear nature of the system), sufficient time can be allowed for complete solidification of any fused product components before the processed material is discharged, and discharge from the containers 15 can be accomplished cleanly. Also as described herein, discharge by gravity may also be combined with a mechanical assist.

The LHF system 10 provides, at least in one embodiment, the advantage of physically separating the cold feed end of the system, i.e., the charging end 20, from the hot product end of the system, i.e., the discharging end 22. The separation of these two ends of the LHF system 10 is automatic and may also provide a simple layout for a plant having such equipment. For example, the processed material from the LHF system 10 may be fed from the discharge end 22 directly to a furnace, e.g., an electric furnace, for final smelting. Such separation of the charging end 20 and discharging end 22 does not exist in a RHF system, or even the PSH system described in the Background of the Invention section herein. In a RHF system, for example, the raw material 88 and the processed material are added and discharged, respectively, from the furnace in the same region. Likewise, for example, in a PSH furnace, one discharging end is directly adjacent a charging end of another paired furnace.

Figure 6A:
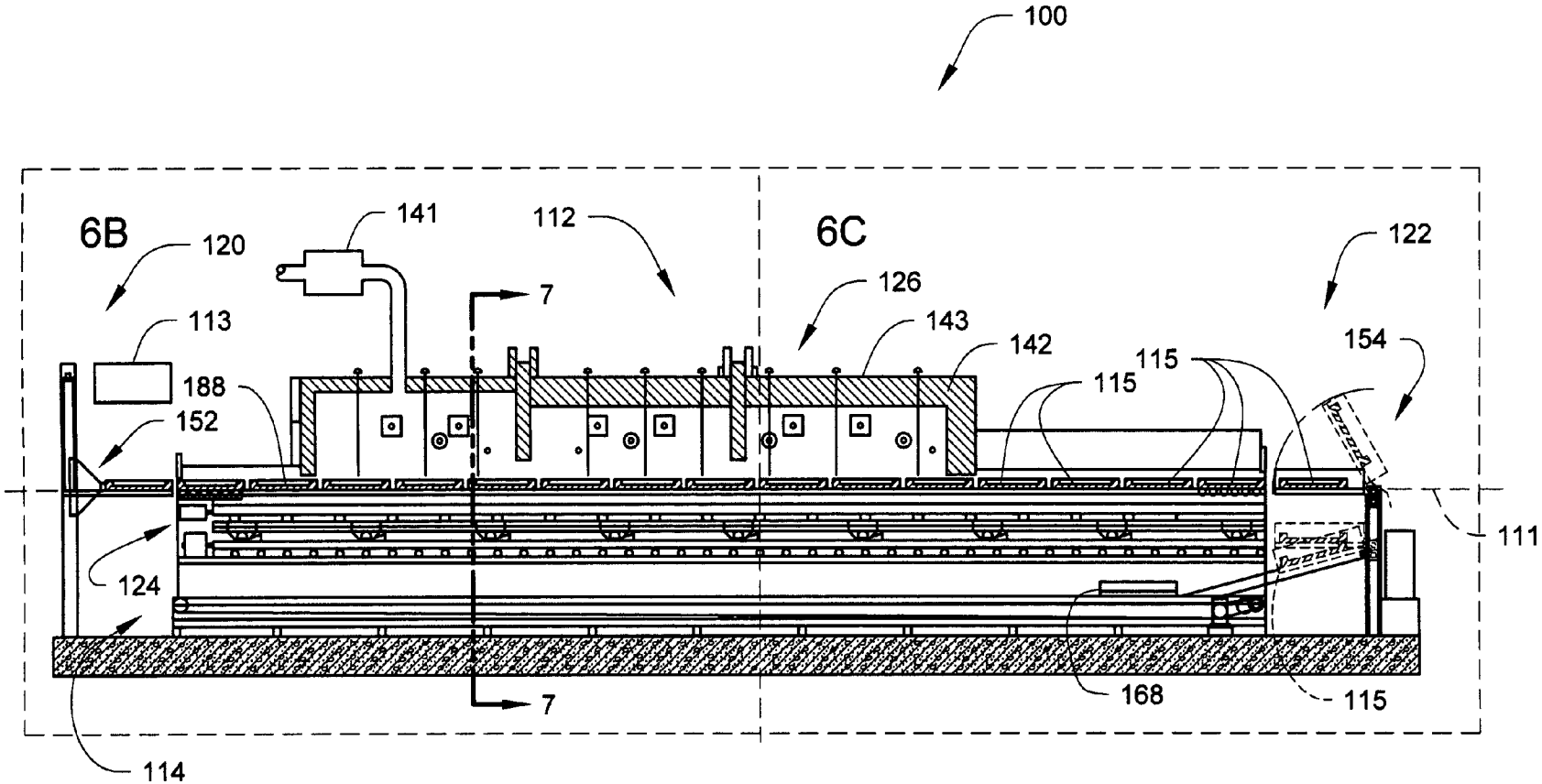
Figure 6B:
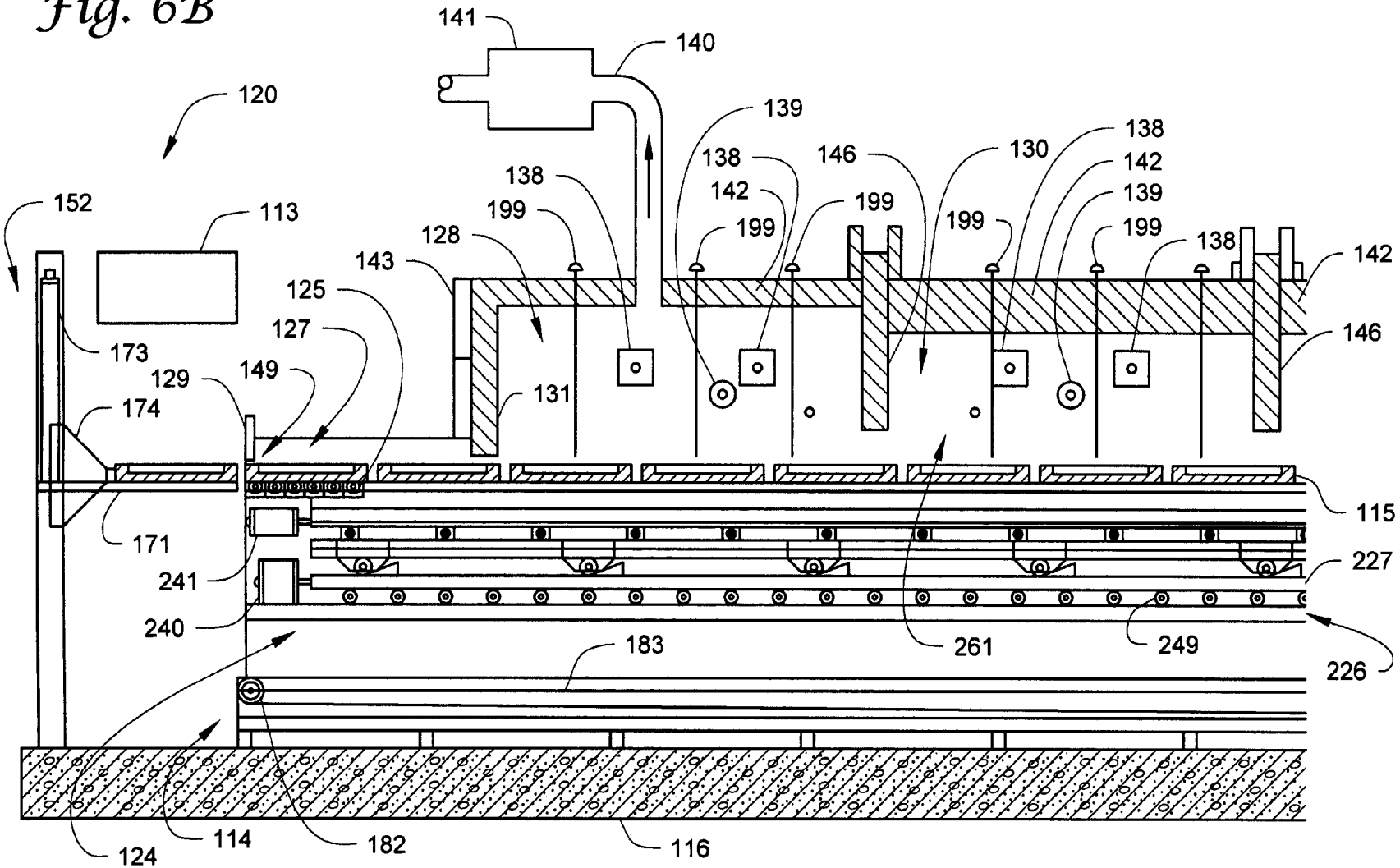
Figure 6C:
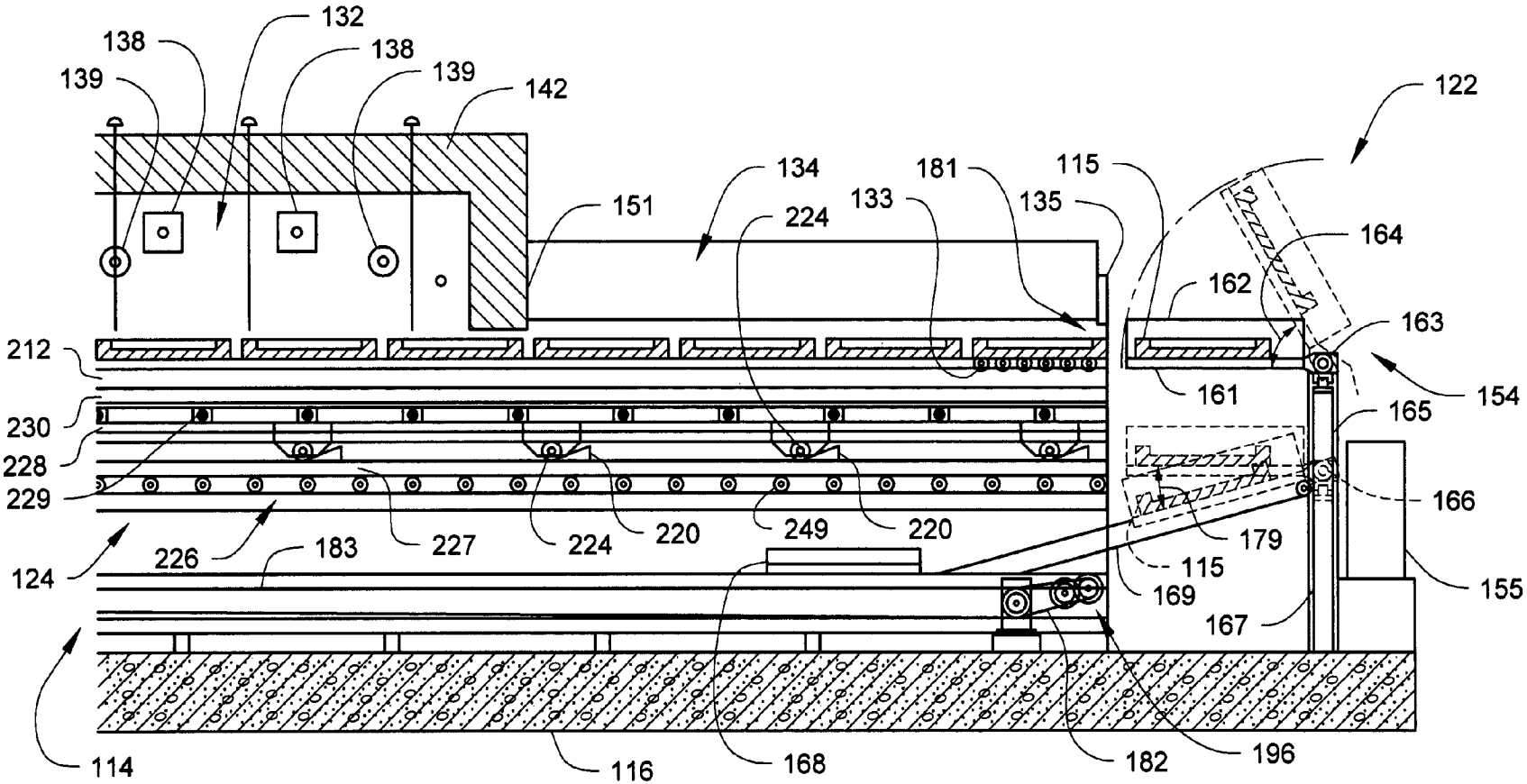
Figure 7:
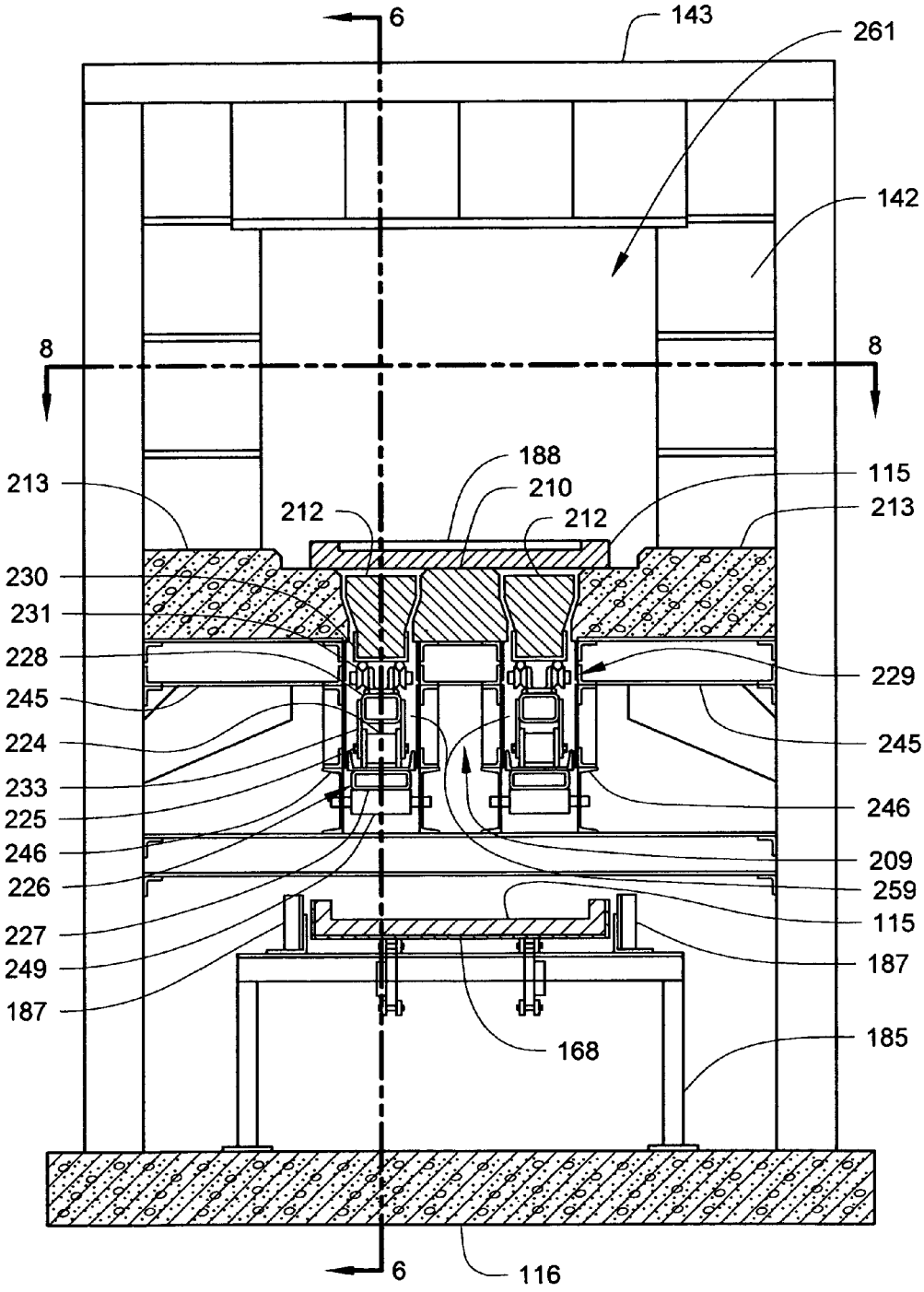
FIG. 7 is a cross-sectional view of the linear hearth furnace system shown in FIGS. 6A-6C taken at line 7-7 of FIG. 6A including portions of a walking beam configuration according to the present invention.
Figure 8A:
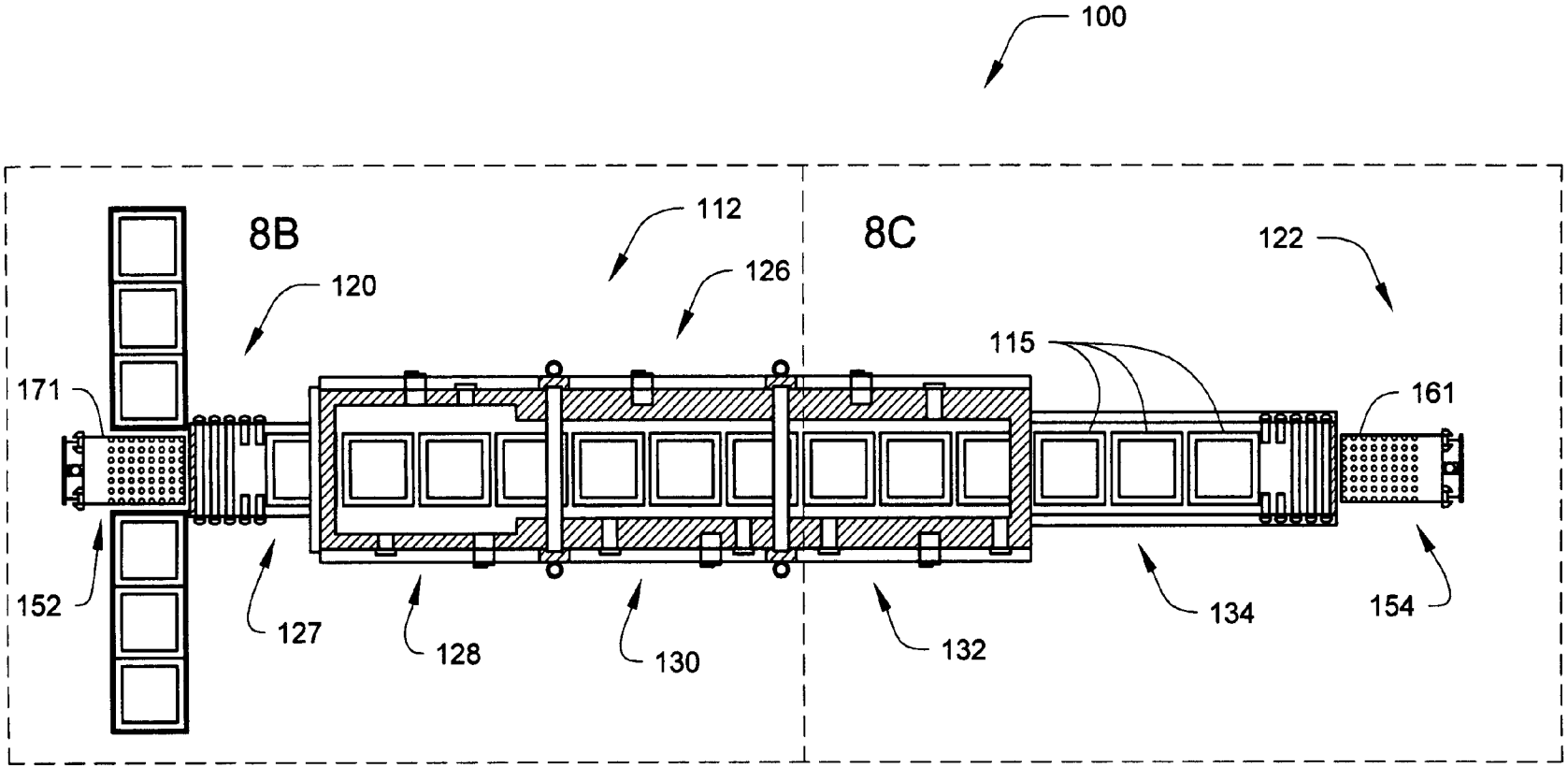
Figure 8B:
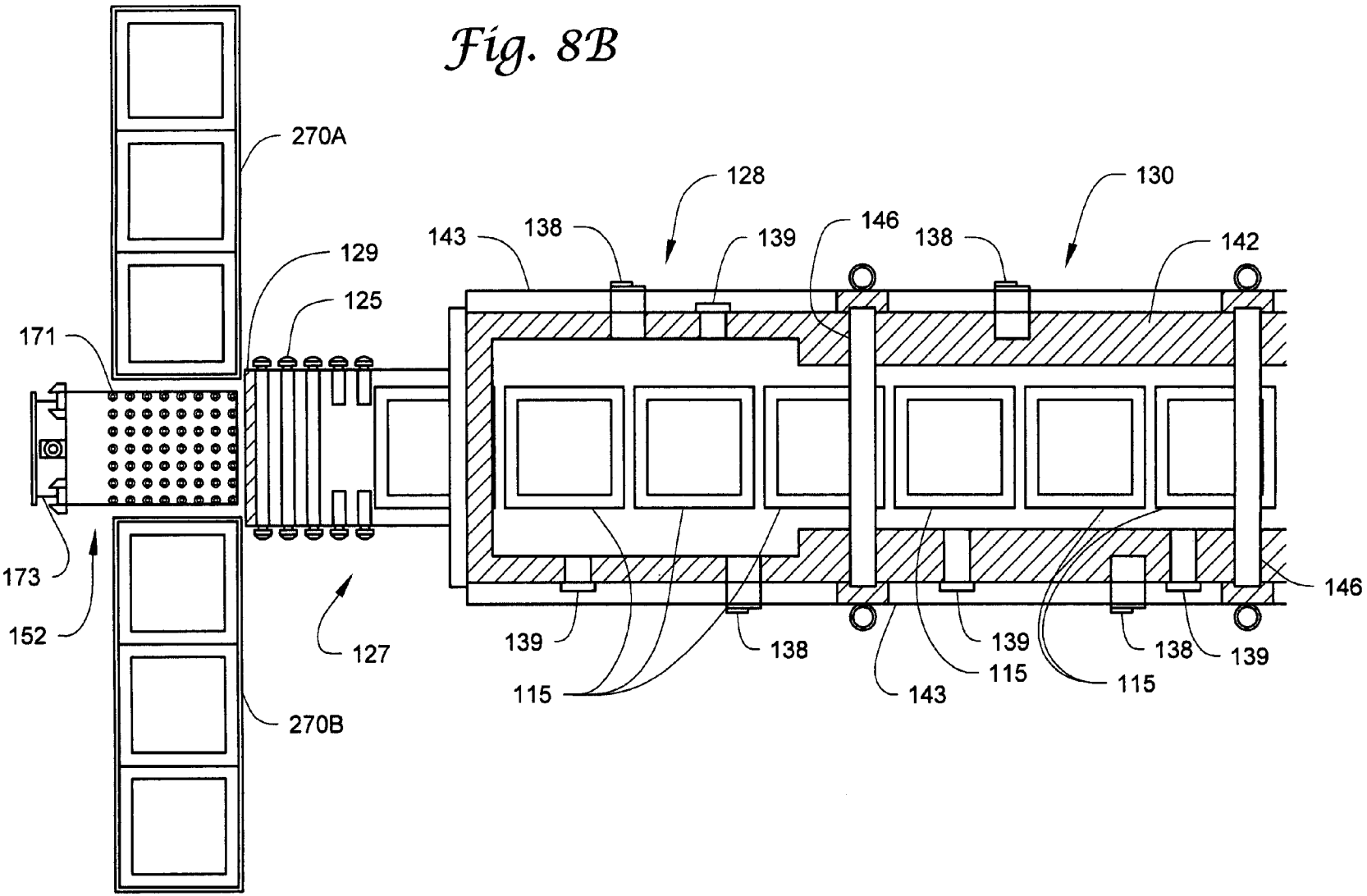
Figure 8C:
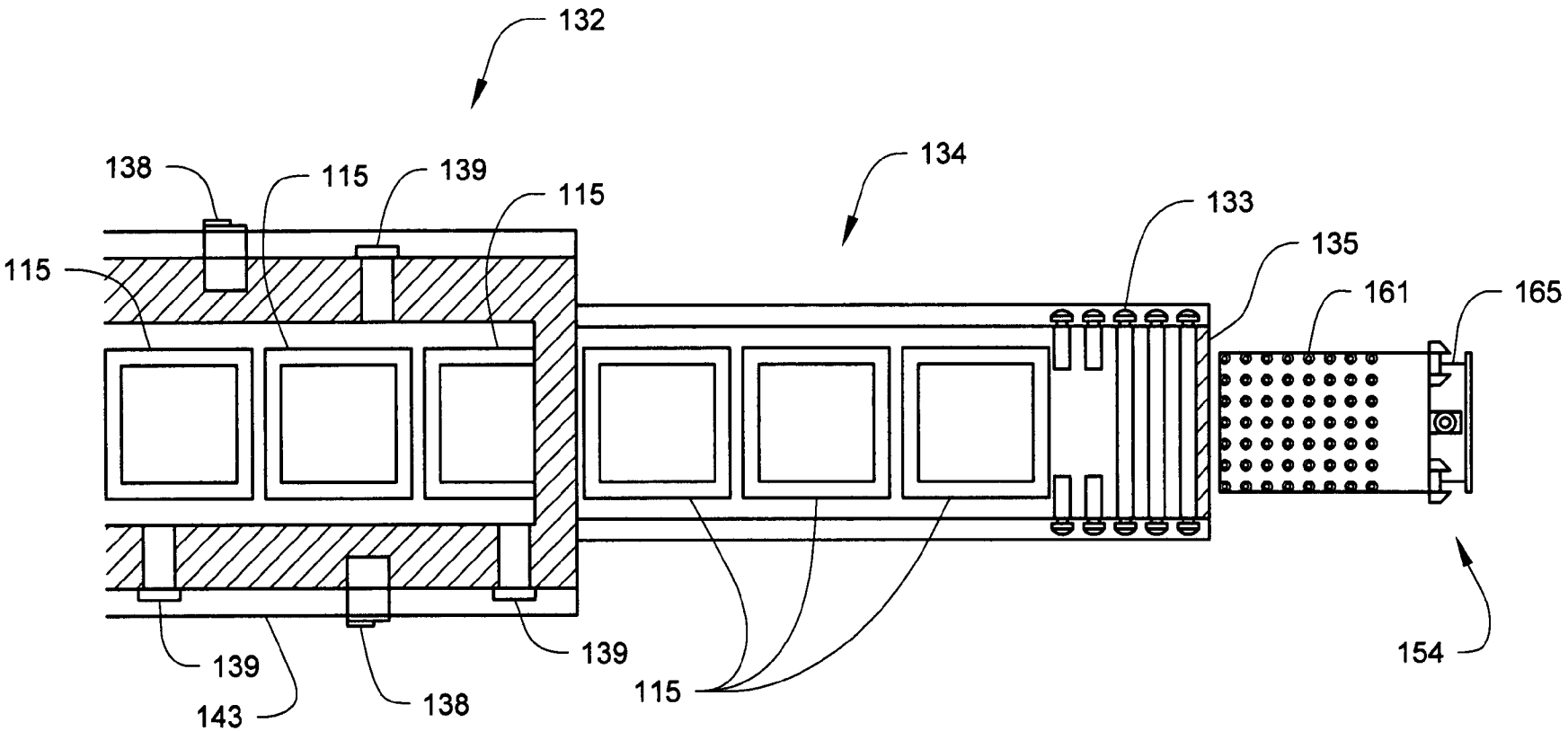

FIGS. 6-8 show one embodiment of an illustrative LHF system 100 according to the present invention such as described generally with reference to FIGS. 1-4. FIG. 6A shows a side view cross-section of the LHF system 100 taken along line 6-6 of FIG. 7, whereas FIGS. 6B and 6C show enlarged portions of FIG. 6A. FIG. 7 shows an end cross-section taken through a zone 128 taken along line 7-7 of the LHF system 100 shown in FIG. 6A. FIG. 8A shows a plan cross-section view taken immediately above the containers 115 traveling through the LHF system 100 along line 8-8 of FIG. 7, whereas FIGS. 8B and 8C are enlarged views of portions of FIG. 8A.

The LHF system 100 is operated under control of a control system (not shown, but which may be any suitable system for controlling the functionality of the furnace) and includes a linear furnace apparatus 112 extending along a longitudinal axis 111 of the LHF system 100. The linear furnace apparatus 112 is operable to move one or more containers 115 from a charging end 120 to a discharging end 122 of the LHF system 100. A feed apparatus 113 (e.g., any suitable feed apparatus such as off-the-shelf feeders) is configured for providing a raw material 188 into the one or more containers 115 such that the raw material may be transported through the linear furnace apparatus 112. The raw material 188 is processed as the container 115 is moved by a container moving apparatus 124 of the linear furnace apparatus 112 through one or more process zones 126 to the discharging end 122 along longitudinal axis 111.

At the discharging end 122, a transfer/discharge apparatus 154 is used to discharge the processed material (e.g., by tilting and allowing gravity to discharge the processed material from the one or more containers 115) and further to transfer the empty container 115 after discharge to a container return apparatus 114. Preferably, the empty container 115 is returned in an upright position to the charging end 120. Further, preferably, the empty container 115 is provided immediately to the charging end 120 directly below the linear furnace apparatus 112. In other words, the container return apparatus 114 is positioned directly below the linear furnace apparatus 112. A transfer apparatus 152 is used to transfer the empty container 115 to a location such that it can once again be fed with raw material 188 and provided to the linear furnace apparatus 112.

As shown in FIGS. 6-8, the linear furnace apparatus 112 extending along longitudinal axis 111 includes one or more zones 126 for use in processing the raw material 188 in the one or more containers 115. The linear furnace apparatus 112 includes a body support structure 143 used at least in part to define the one or more zones 126 (e.g., metal structural walls and other supporting structure). As shown in FIG. 7, the body support structure 143 includes beams and metal panels configured to define a linear path extending through the one or more zones 126 for processing of raw material 188 in the one or more separate or separable containers 115. Depending upon the functionality of the particular zones 126, and as shown in FIG. 7, one or more types of insulating material 142 (e.g., lining one or more portions of the body support structure) are employed to assist in maintaining high temperatures in one or more of the zones defined by the body support structure 143. For example, the furnace zones such as reduction zone 130 and fusion/melting zone 132 are lined with a high temperature fiber insulating material.

As best shown in FIGS. 6 and 7, transport of the one or more separate or separable containers 115 along the linear path is provided by container moving apparatus 124 provided in the form of a walking beam configuration. Although various walking beam configurations may provide for the transport of the one or more separate or separable containers 115 along the linear path through the linear furnace apparatus 112, the configuration shown particularly in FIGS. 6-7 includes a lift and shift walking beam configuration that utilizes a simple wedge 220 and roller 224 design. The use of walking transport beams 212 assists in the movement of the one or more separate or separable containers 115 through the linear furnace apparatus 112 along the linear path.

The mechanical arrangement for raising and lowering the beams may be different depending upon the size of the linear furnace apparatus 112 (e.g., use of hydraulic driven lift pistons or a mechanical lever arm system). Further, it may even be possible that the one or more containers 115 may be moved through the linear furnace apparatus 112 on rollers, or supported by a continuous chain by providing water-cooled jacketing for the roller supports.

The walking beam configuration shall be described in further detail with reference to FIGS. 6-7. As shown therein, a container 115, when not supported by the walking transport beam 212, is supported by side resting portions 213 and insulated center beam 210 (e.g., such resting portions or beams may be formed of an insulating or refractory material). Generally, the center beam 210 is aligned along the longitudinal axis 111 of the linear furnace apparatus 112. The center beam 210 is supported by center beam support structure 209 and the side resting portions 213 are supported by support structure 245. Such support structure, along with other support structure 246, define sealed regions 259, wherein mechanisms relating to the movement of walking transport beams 212 are located. Such regions 259 are mechanically sealed using support structure such as one or more of structures 245, 246, and 209, such that gases from the interior 261 of the linear furnace apparatus 112 are prevented from escaping the linear furnace apparatus 112, and, likewise, ambient air is prevented from entering the interior 261 of the linear furnace apparatus 112.

As shown in FIGS. 6A-6C and FIG. 7, a series of wedges 220 are supported in the defined openings 259 by wedge support structure 226 including motion beam 227. The motion beam 227 is provided with motion by way of hydraulic apparatus 240 and is allowed to roll on roller 249 of wedge support structure 226. The wedges 220 are not shown in FIG. 7, however, such wedges 220 are shown mounted on motion beam 227 of wedge support structure 226 in FIGS. 6A-6C.

The motion of motion beam 227 is coupled through to the walking transport beams 212 by means of walking beam coupler 229. The walking beam coupler 229 includes the rollers 224 which are configured to roll up and down wedges 220 as the walking beam operates. The rollers 224 are pivotably coupled at pivot point 225 to carrier beam 228 by support plates 233, with one end of support plates 233 being pivotably coupled at pivot point 225 to rollers 224 and the other end of the plate being fixed to carrier beam 228. A pivot coupling 231 is used for coupling the carrier beam 228 to trough 230 which defines an opening for supporting the insulated material of walking transport beams 212. A hydraulic apparatus 241 is coupled at the charging end 120 in a manner so as to move the trough 230 supporting the walking transport beams 212.

Using the motion of motion beam 227 and walking transport beams 212 as controlled by hydraulic apparatus 240 and 241, transport of containers 115 is provided along the linear path of a linear furnace apparatus 112. For example, as the wedges 220 are moved toward the charging end 120 by hydraulic apparatus 240, the walking transport beams 212 (i.e., supported by the carrier beam 228 carried by roller 224) are raised as roller 224 is rolled upon wedges 220 imparting a lift to the transport beams 212 and containers 115 coupled to trough 230 which supports the walking transport beams 212. A sequential movement by hydraulic apparatus 241 moves the transport beams 212 and containers 115 toward the discharging end 122 (e.g., 6 to 12 inches of motion). Reversing such motions utilizing the hydraulic apparatus 240 and 241 provides for the lowering of the containers 115 such that they rest upon side resting portions 213 and center beam 210 and moves the walking beams 212 toward the charging end 220 of the LHF system 100 prior to repeat of the lifting and translation cycle which moves the one or more containers 115 towards the discharging end 122.

The LHF system 100 shown in FIGS. 6-8 is configured in this particular embodiment for use in a direct reduction process. Such direct reduction processes are well known in the art and shall not be described in further detail herein. However, because the direct reduction process requires various processing techniques and zones 126 for accomplishing such processing, a short description with respect to each of the one or more zones 126 shown in the exemplary embodiment of LHF system 100 shall be described. The linear furnace apparatus 112 includes a feed zone 127. The feed zone 127 is configured to receive the one or more containers 115 and provides for insertion of containers 115 into the furnace through a sealed door or closure 129 to minimize infiltration of ambient air into the furnace and also provides a temperature buffer zone so containers 115 and charge are not immediately exposed to high temperatures of the preheat zone 128.

For example, as shown in FIG. 6B, a roller section 125 of the feed zone may assisting in receiving containers 115 through an opening 149 at the charging end 120. The opening or inlet 149 into the furnace may be opened or closed using a closure apparatus 129. For example, the closure apparatus 129 may be a ceramic fiber curtain, a refractory composite door, a vertical slide gate, or a panel, with one or more types of actuators operable for opening and closing the inlet opening 149 into the feed zone 127. One will recognize that any suitable mechanism for opening and closing the inlet opening 149 to the feed zone 127 to minimize escape of the furnace gases or entrance of ambient air may be utilized (e.g., the transfer apparatus 152 or structure 171 may be used to physically lift the closure apparatus 129 as the container is lifted in position to be inserted into the furnace 112).

Structure 131 of the linear furnace apparatus 112 defines an opening for allowing containers 115 to pass from the feed zone 127 into a preheat zone 128 of the linear furnace apparatus 112. Optional baffle structures 146 may be utilized to create further zones, including reduction zone 130 and fusion/melting zone 132, for processing of the raw material 188 in the one or more containers 115. In addition, such baffle structures 146 allow for the transfer of gases from one zone to another zone and also into the preheat zone 128.

As similarly described with reference to FIG. 1, conduit or discharge flue 140 provides for exhaust of gases in this counter flow designed furnace. The discharge component block 141 is representative of the components required to assist in such discharge of the hot exhaust gases. For example, such components for at least one embodiment have been described with reference to FIG. 1 and will not be described in any further detail with reference to FIGS. 6-8.

As previously described herein, the preheat zone 128 provides for preheating or drying of wet raw material in a direct reduction process. For example, in addition to drying the material, such a preheating process dries off volatile components in the raw material 188. In this particular exemplary embodiment, the preheat zone 128 may be held at a temperature of about 1000° F. to about 2000° F. by gas burners 138 positioned therein and controlled by controller (not shown) such as through use of roof-mounted thermocouples 199. As one skilled in the art will readily recognize, various sensors may be utilized with the linear furnace apparatus 112 for use in controlling the atmosphere in the interior 261 thereof. For example, carbon dioxide, carbon monoxide, and oxygen sensors may be used to monitor and control the reducing potential of the furnace atmosphere. Further, site ports 139 may be included in one or more of the zones to provide for visual examination of the interior 261 of portions of the furnace apparatus 112.

The containers 115 are then moved along the linear path of the linear furnace apparatus 112 from the preheat zone 128 to a reduction zone 130 where a chemical reduction process occurs to reduce the raw material 188 (e.g., an iron bearing material such as iron oxide). Generally, for example, the temperature within the reduction zone 130 is maintained at a temperature in the range of about 1800° F. to about 2400° F. using controller (not shown) and one or more sensors such as thermocouples 199, and further with use of gas burners 138.

The containers 115 are then moved along the linear path of the linear furnace apparatus 112 from the preheat zone 128 to a reduction zone 130 where a chemical reduction process occurs to reduce the raw material 188 (e.g., an iron bearing material such as iron oxide). Generally, for example, the temperature within the reduction zone 130 is maintained at a temperature in the range of about 1800° F. to about 2400° F. using a controller (not shown) and one or more sensors such as thermocouples 199, and further with use of gas burners 138.

As described elsewhere herein, after formation of, for example, metallic iron nuggets in a direct reduction process, such processed material is generally cooled. As such, the one or more containers 115 are provided from the fusion/melting zone 132 to a cooling zone 134 through an opening defined by structure elements 151 extending down towards the container moving apparatus 124. The cooling zone 134 is preferably configured as a water jacket wherein water is provided to the cooling zone 134, heated through the transfer of heat from the processed raw material to the water, with the heated water being transported from the cooling zone 134. Such water jackets are readily known, available, and/or described in a variety of configurations and need not be described in further detail herein.

The one or more containers 115 are transferred from the cooling zone 134 with use of a roller assist mechanism 133. An actuated closure mechanism 135 is provided at the outlet 181 of the cooling zone 134 for preventing ambient air from entering into the zone and also preventing gases from escaping therefrom. The actuated closure mechanism 135 may be similar or different to that of actuated closure 129 and include any suitable apparatus for minimizing air or gas movement through the outlet 181.

The one or more containers 115, after processing of the raw material 188 provided therein, are transported from the cooling zone 134 to the discharge and transfer apparatus 154. The discharge and transfer apparatus 154, as shown in one exemplary embodiment, includes a transfer platform 161 (e.g., a platform comprising a plurality of ball-bearings on an upper surface thereof, as shown best in FIG. 8C, and further including wall structures 162 as shown in FIG. 6C) for assisting in transfer of containers 115 from the discharging end 122 of the linear furnace apparatus 112 to the container return apparatus 114 for return of empty containers 115 to the charging end 120 of the LHF system 100.

Prior to such transfer to the container return apparatus 114, the processed material is discharged using gravity. For example, the container 115, including the processed material (e.g., metallic iron nuggets), is raised to a particular predetermined angle 164 by hydraulic apparatus 165. The transfer platform 161 is pivotable at pivot point 163 for allowing rotation of the transfer platform 161 to angle 164. Any processed material may then be provided by gravity into a collection container 155 for use in, for example, the transfer to one or more further apparatus. One skilled in the art will recognize that various mechanical assist devices may also be used to clean the processed material from the container 115, if necessary.

After return of the empty container 115 to horizontal from angle 164, a hydraulic apparatus 167 is used to lower the transfer platform 161 to allow transfer of the empty container 115 to the return apparatus 114. The empty container 115 is then transferred to a carrier cart device 168 by rotating the transfer platform 161 to a particular angle 179 about pivot point 166. The empty container 115 is then transferred to the carrier cart device 168 using gravity with proper alignment by guide and centering blocks or rollers 169. Further, although the container 115 may be moved to the carrier cart device 168 by gravity, other mechanical assist devices (e.g., imparted cable motion, belt, or any other movement mechanism) may be used in combination to provide the container 115 to the carrier cart device 168 of the container return apparatus 114. One will recognize that although a carrier cart is used in this particular embodiment, that the container 115 may be transported to charging end 120 without a cart in one or more other embodiments of the present invention.

The container return apparatus 114 includes a return apparatus structure 185 supported upon pad 116 in addition to wall structures 187 for retaining and directing the container 115 during its return to the charging end 120 of the LHF system 100. The container return apparatus 114 further includes the carrier cart device 168 and cable apparatus including rollers 182 and cable 183 driven by a motor apparatus 196 used to impart motion to cable 183 which is attached in some manner to carrier cart device 168, and therefore is used to impart motion to the empty container 115. Using the container return apparatus 114, the container is moved towards the charging end 120 of the LHF system 100. The cable-driven apparatus may be used because of the relatively lightweight nature of the horizontal and non-self-mobile nature of the containers 115. However, one skilled in the art will recognize that a belt mechanism or any other transfer apparatus may be used to move the containers 115 (whether in a cart or alone) to the charging end (e.g., a transport apparatus that can be located and operable below the linear furnace apparatus 112).

The carrier cart device 168 may be any suitable apparatus for receiving an empty container and providing adequate support thereto during transport. For example, the cart device 168 may include one or more of the following features: a planar bottom portion coupled to the cable 183, one or more sidewalls (e.g., extending from the bottom portion) for retaining the empty container on the cart device 168 as it is transported, apparatus to assist in receiving the container 115 or moving the container to another apparatus (e.g., rollers, ball bearings, hydraulics, etc.). One will recognize that the cart device may be configured in any number of different manners, shapes and sizes, and that the present invention is not limited to any particular configuration.

Another embodiment of a carrier cart 200 that may be used according to the present invention is shown in FIGS. 9A-9E. FIGS. 9A-9E show various views of the carrier cart 200 and associated features of a container return apparatus that may be used in one or more embodiments of the present invention.

Figure 9A:
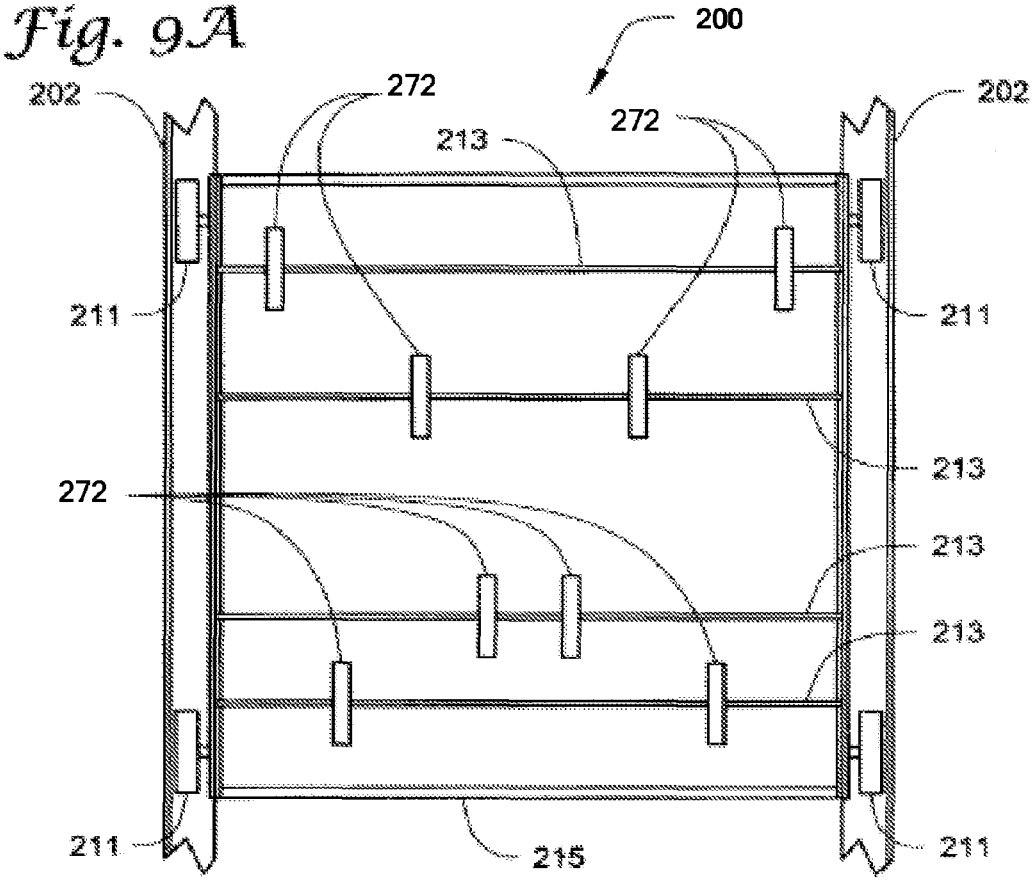
FIGS. 9A-9E show various views of a carrier cart and associated features of a container return apparatus that may be used in one or more embodiments of the present invention.

FIG. 9A is a plan view of the carrier cart 200 shown on a pair of tracks 202 (e.g., angle iron channels or any other suitable track structure for supporting and/or allowing wheels to travel thereon) for guiding the carrier cart 200. The carrier cart 200 includes a set of outside wheels 211 that support a cart frame 215 (e.g., four outside wheels at the corners of a generally square frame). The carrier cart 200 further includes a set of transfer wheels 272 in the interior of the carrier cart 200 for receiving a container 115 thereon.

Figure 9B:
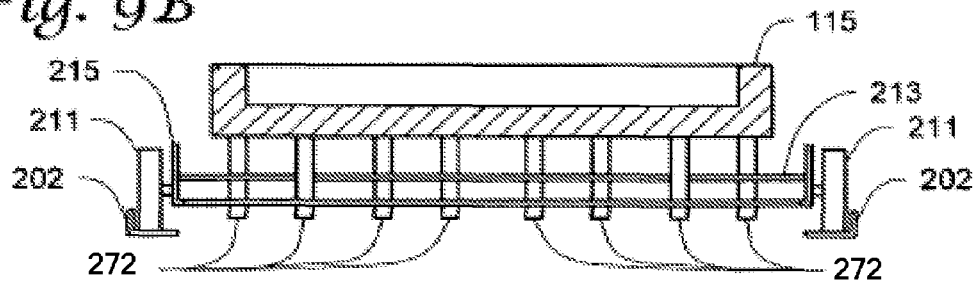
Figure 9C:
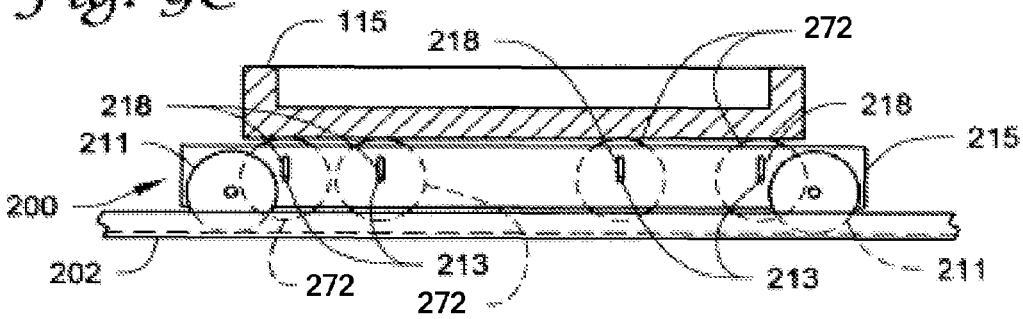
Figure 9D:
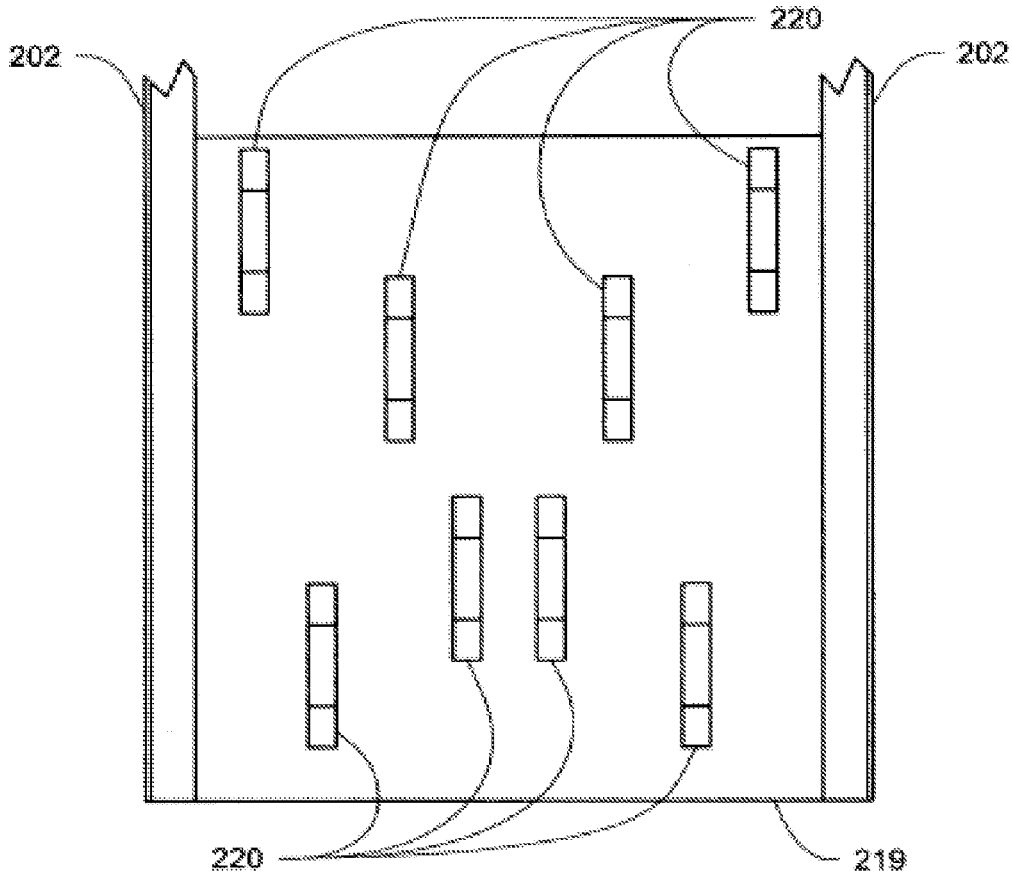
Figure 9E:
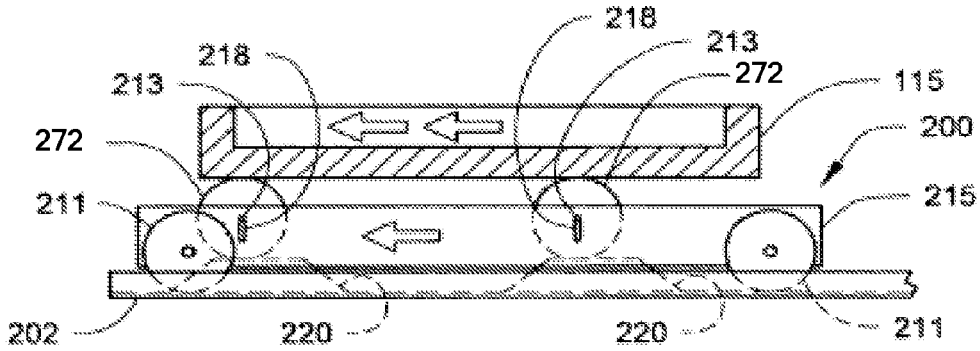

The set of transfer wheels 272 include a plurality of pairs of transfer wheels; each pair of transfer wheels is caffied by a floating shaft 213 that is free to move up and down (i.e., vertically) within slots 218 on opposing edges of cart frame 215 (best shown in FIGS. 9C and 9E). For example, in one embodiment, the carrier cart 200 includes four pairs of transfer wheels 272 with each pair carried by a floating shaft 213 that are free to move up and down in slots 218 (e.g., about an inch).

FIG. 9B is a front view of the carrier cart 200 showing the outside wheels 211 running in the tracks 202 carrying the cart frame 215 that supports the free wheeling transfer wheels 272. A container 115 is shown resting on transfer wheels 272 (e.g., such as at the discharge end 122 of the LHF system 100). For example, a container 115 may be allowed by gravity to slide onto the carrier cart 200 from the transfer apparatus 154 with the wheels assisting in receiving the container 115.

FIG. 9C is a side view of the carrier cart 200 shown on such tracks 202 with a container 115 resting on transfer wheels 272 thereof. As shown therein, when the container 115 is received at the discharge end 122 of the LHF furnace 100, the weight of the container 115 moves the floating shafts 213 towards the bottom of the slots 218. During the return of the container 115 to the charging end 120, the shafts 213 rest at the bottom of the slots 218 and the wheels 272 are not in motion.

FIG. 9D is a top view of a discharge plate 219 located between the tracks 202 of a container return apparatus towards the charging end 120 of the LHF furnace 100. The discharge plate 219 includes a set of ramps 220 at positions corresponding to the set of transfer wheels 272 for use in discharge of a container 115 from the carrier cart.

FIG. 9E is a side view of the carrier cart 200 shown at the time of discharge of the container from the carrier cart 200 and onto the transfer apparatus 152 at the charging end 120 of the LHF furnace using the discharge plate of FIG. 9D (with only two of the transfer wheels used for clarity and simplicity).

In this carrier cart embodiment of the present invention, as the cart 200 approaches the charging end 120 where the discharge plate 219 is located, the transfer wheels 272 ride up (e.g., preferably simultaneously) the ramps 220 to propel the container 115 forward, and off the carrier cart 200 and onto the transfer apparatus 152 to be moved to the inlet to the furnace apparatus 112. The arrows in FIG. 9E indicate the relative velocity of the container 115 opposed to that of the carrier cart at discharge. In other words, the shafts 213 are raised in the slots 218 as contact occurs between the transfer wheels 272 and the ramps 220. This contact imparts a rolling effect on the transfer wheels 272 moving the container 115 in the direction of the arrows.

Generally with further reference to the configuration shown in FIGS. 6-8, at the charging end 120 of the LHF system 100, transfer apparatus 152 is used to transfer the empty container 115 from the container return apparatus 114 to the inlet opening 149 of the feed zone 127 for insertion therein. As shown in FIG. 6B, the transfer apparatus 152 includes a hydraulic apparatus 173 for raising and lowering a transfer platform 171 (e.g., a transfer platform having a plurality of ball-bearings on a surface thereof to mechanically assist in the transfer of the containers 115). The hydraulic apparatus 173 is operable for lowering the transfer platform 171 to a level for receiving an empty container 115 from the container return apparatus 114, and to move the empty container to a higher level as necessary for insertion of the container 115 into the feed zone 127. In one embodiment, a pushing apparatus 174 may be used to assist in transfer of the container 115 from the transfer platform 171 and into feed zone 127 with the assistance of roller apparatus 125.

As shown in FIG. 8B, a plurality of roller conveyers 270A and 270B are provided for the insertion of charged containers (e.g., preloaded containers on conveyors 270A) into the line of containers being process and removal of hot containers (e.g., empty containers on conveyors 270B) from the line of containers being processed. In this particular embodiment, this arrangement is provided for semi-batch type operation of, for example, a prototype furnace. It will be recognized by one skilled in the art that such operations (e.g., charging the hot return containers, and removal and replacement of damaged hot containers) may be carried out "in-line" in a full scale commercial operation. Further, it will be recognized that scaling the present LHF system 100 is much easier than other designs due to its linear nature.

One will recognize that the furnace zones are generally created in a symmetrical manner in the exemplary embodiment, such that one or more sections of such zones may be added depending upon the processing necessary for the raw material. Further, as this is a linear system, the linear path may be extended such that a longer preheat, feed, cooling, or additional furnace zones can be easily added by insertion of additional modular units configured for the functionality required.

In one embodiment, a container 115 that needs to be recycled may be removed from the transfer platform 161 at the discharging end 122 prior to its return to the charging end 120 using container return apparatus 114. In addition, various other transfer concepts to remove a container 115 and/or insert a different container in its place may be provided as modifications to the LHF system 100 at one or more various locations of the system (e.g., at the charging end 120, at the discharging end 122, or even at a location therebetween).

All patents, patent documents, and references cited herein are incorporated in their entirety as if each were incorporated separately. This invention has been described with reference to illustrative embodiments and is not meant to be construed in a limiting sense. As described previously, one skilled in the art will recognize that other various illustrative applications may use the techniques as described herein to take advantage of the beneficial characteristics of the particles generated hereby. Various modifications of the illustrative embodiments, as well as additional embodiments to the invention, will be apparent to persons skilled in the art upon reference to this description.

What is claimed is:

1. A method for use in processing raw material, wherein the method comprises:

providing a linear furnace apparatus extending along a longitudinal axis between a charging end and a discharging end, wherein the linear furnace apparatus comprises at least one furnace zone positioned along the longitudinal axis;

providing a plurality of separate or separable containers, each container comprising refractory material;

providing raw material comprising a mixture of iron oxide and carbonaceous material into one or more of the plurality of separate or separable containers at the charging end of the linear furnace apparatus;

moving the one or more separate or separable containers through the at least one furnace zone and to the discharging end of the linear furnace apparatus and, within the linear furnace apparatus, i) preheating the raw material, ii) reducing the iron oxide resulting in processed material in the one or more separate or separable containers, the processed material comprising metallic iron and slag, and iii) fusing and melting the resultant metallic iron and slag;

discharging the processed material from the one or more separate or separable containers resulting in one or more empty containers; and returning the one or more empty containers to the charging end of the linear furnace apparatus to receive further raw material.

2. The method of claim 1, wherein step of providing a linear furnace apparatus comprises providing a linear furnace apparatus comprising at least a preheat zone, said at least one furnace zone, and a cooling zone positioned along the longitudinal axis between the charging end and the discharging end.

3. The method of claim 2, wherein the step of providing a linear furnace apparatus comprises providing a linear furnace apparatus comprising said at least one zone of the preheat zone, the at least one furnace zone, and the cooling zone configured using multiple modular linear sections corresponding to the particular zone being configured to allow lengthening or shortening of the at least one zone along the longitudinal axis.

4. The method of claim 1, wherein the one or more separate or separable containers comprise one or more separate or separable passive containers, wherein the one or more separate or separable passive containers lack self mobility.

5. The method of claim 1, wherein the step of moving the one or more separate or separable containers comprises moving the one or more separate or separable containers using a walking beam configuration, wherein each of the one or more separate or separable containers is supported by one or more transport beams of the walking beam configuration as the one or more separate or separable containers is moved along the longitudinal axis of the linear furnace apparatus and through the at least one furnace zone.

6. The method of claim 5, wherein the one or more of the transport beams comprises an insulating material in contact with the one or more separate or separable containers.

7. The method of claim 5, wherein the walking beam configuration is substantially mechanically sealed.

8. The method of claim 1, wherein the step of discharging the processed material from the one or more separate or separable containers comprises tilting the one or more separate or separable containers to discharge the processed material using at least gravity.

9. The method of claim 1, wherein the step of returning the one or more empty containers to the charging end of the linear furnace apparatus comprises immediately returning the one or more empty containers to the charging end of the linear furnace apparatus.

10. The method of claim 1, wherein the step of returning the one or more empty containers to the charging end of the linear furnace apparatus comprises returning the one or more empty containers to the charging end of the linear furnace apparatus in an upright state.

11. The method of claim 1, wherein the step of returning the one or more empty containers to the charging end of the linear furnace apparatus comprises returning the one or more empty containers to the charging end of the linear furnace apparatus using a container return apparatus located directly below the linear furnace apparatus.

12. The method of claim 1, wherein the method further comprises removing one or more of said one or more empty containers and replacing the one or more removed empty containers with one or more different empty containers.

13. The method of claim 1, wherein the step of providing a plurality of separate or separable containers comprises providing at least one of the one or more separate or separable containers having an underlying substructure supporting a refractory material.

14. The method of claim 13, wherein the step of providing a plurality of separate or separable containers comprises providing the underlying substructure having a floating planar bottom panel coupled to a frame portion such that the floating planar bottom panel is allowed to expand relative to the frame portion.

15. The method of claim 13, wherein the step of providing a plurality of separate or separable containers comprises providing the underlying substructure having a planar bottom panel having one or more slot openings defined therein.

16. The method of claim 1, wherein the step of preheating the raw material comprises preheating the raw material at a temperature of about 1000° F. to about 2000° F.

17. The method of claim 1, wherein the step of reducing the iron oxide comprises heating the raw material at a temperature of about 1800° F. to about 2400° F.

18. The method of claim 1, wherein the step of fusing and melting the resultant metallic iron and slag comprises heating the resultant metallic iron and slag at a temperature of about 2200° F. to about 2700° F.

* * * * *